US006126413A

United States Patent [19]

Berke-Jørgensen

[11] Patent Number: 6,126,413

[45] Date of Patent: Oct. 3, 2000

[54] APPARATUS FOR USE IN LIQUID CIRCULATION SYSTEM AND METHOD FOR USING SAID APPARATUS

[75] Inventor: Jørgen Berke-Jørgensen, Skanderborg, Denmark

[73] Assignee: T. Smedegaard A/S, Denmark

[21] Appl. No.: 09/125,677

[22] PCT Filed: Feb. 26, 1996

[86] PCT No.: PCT/DK96/00082

§ 371 Date: Aug. 24, 1998

§ 102(e) Date: Aug. 24, 1998

[87] PCT Pub. No.: WO97/32127

PCT Pub. Date: Sep. 4, 1997

[51] Int. Cl.[7] ..... F04B 17/00; F04B 35/00

[52] U.S. Cl. ..... 417/401; 417/391; 417/46; 417/342

[58] Field of Search ..... 55/29; 60/645, 60/486; 417/391, 46, 237, 401, 403, 342, 27, 318, 404; 62/238.4

[56] References Cited

U.S. PATENT DOCUMENTS

| | | | |
|---|---|---|---|
| 3,890,064 | 6/1975 | Boehringer et al. | 417/237 |
| 3,991,574 | 11/1976 | Frazier | 60/645 |
| 4,011,723 | 3/1977 | Ross | 60/486 |
| 4,439,114 | 3/1984 | Kimmell | 417/403 |
| 4,477,232 | 10/1984 | Mayer | 417/342 |
| 4,523,895 | 6/1985 | Silva . | |
| 4,560,323 | 12/1985 | Orchard | 417/27 |
| 4,611,973 | 9/1986 | Birdwell | 417/342 |
| 4,659,344 | 4/1987 | Gerlach et al. | 55/29 |
| 4,674,958 | 6/1987 | Igarashi et al. . | |
| 4,830,583 | 5/1989 | Edson | 417/318 |
| 4,895,497 | 1/1990 | Schlinkheider | 417/403 |
| 5,498,138 | 3/1996 | Nimberger et al. | 417/46 |
| 5,509,274 | 4/1996 | Lackstrom | 62/238.4 |
| 5,588,813 | 12/1996 | Berke-Jorgensen | 417/391 |
| 5,616,005 | 4/1997 | Whitehead | 417/46 |
| 5,863,188 | 1/1999 | Dosman | 417/391 |

FOREIGN PATENT DOCUMENTS

| | | | |
|---|---|---|---|
| 0179371 | 4/1986 | European Pat. Off. . | |
| WO 93/22556 | 11/1993 | WIPO | 417/391 |

*Primary Examiner*—Teresa Walberg
*Assistant Examiner*—Leonid Fastovsky
*Attorney, Agent, or Firm*—Larson & Taylor, PLC

[57] ABSTRACT

The invention relates to an apparatus for use in a liquid circulation system of the kind comprising a primary circulatory circuit provided with a circulation pump and having a primary forward flow and a primary return flow, as well as a secondary circulatory circuit with a secondary forward flow and a secondary return flow, said primary and secondary forward and return flow being connected to the apparatus, and the liquid circulating in the primary and secondary circulatory circuits being of substantially the same composition. The apparatus comprises two positively interconnected displacement machines (A, B), of which one (A) receives the primary forward flow (P.F.) and delivers the secondary forward flow (S.F.), whilst the other (B) receives the secondary return flow (S.R.) and delivers the primary return flow (P.R.), the volumetric effects for the displacement machines (A, B) being mutually attuned so as to ensure that the volume flows in the primary forward flow, the secondary forward flow, the secondary return flow and the primary return flow are substantially equal. This makes it possible to operate with different pressures in the primary and the secondary circulatory circuits, respectively, without the necessity of using a heat exchanger between them. The invention also comprises control facilities for protecting against loss of liquid from the primary circuit to the secondary circuit in the case of leakage in the latter.

29 Claims, 17 Drawing Sheets

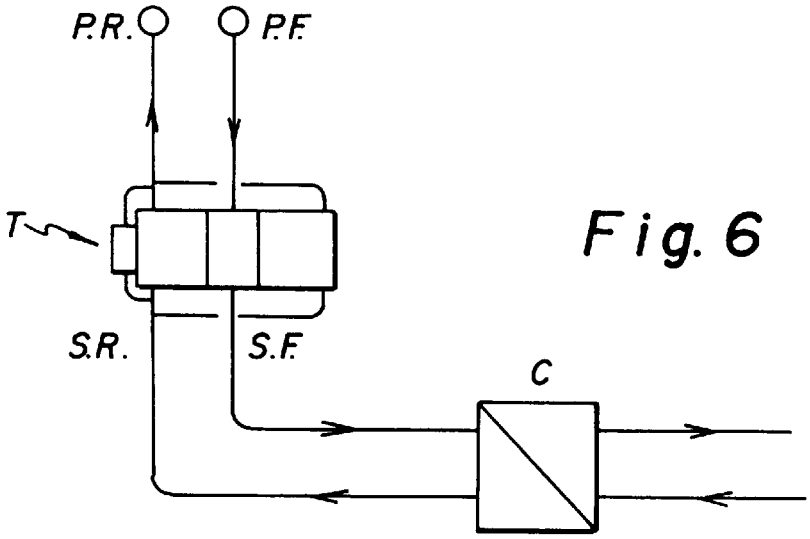
Fig. 6
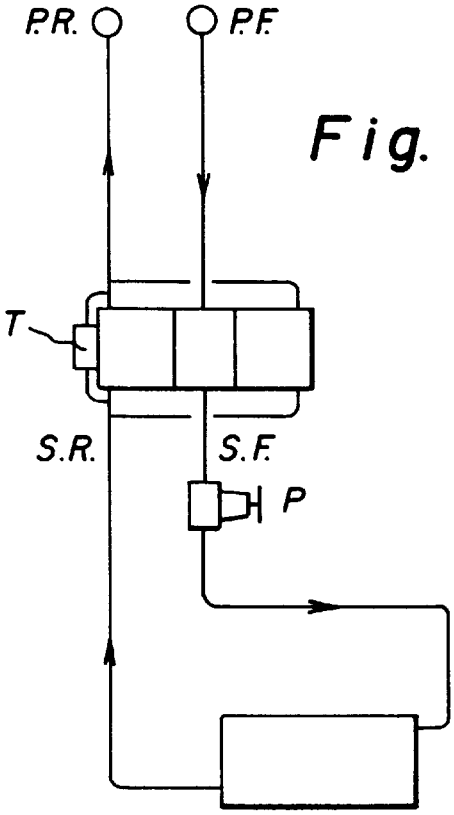
Fig. 7
Fig. 8
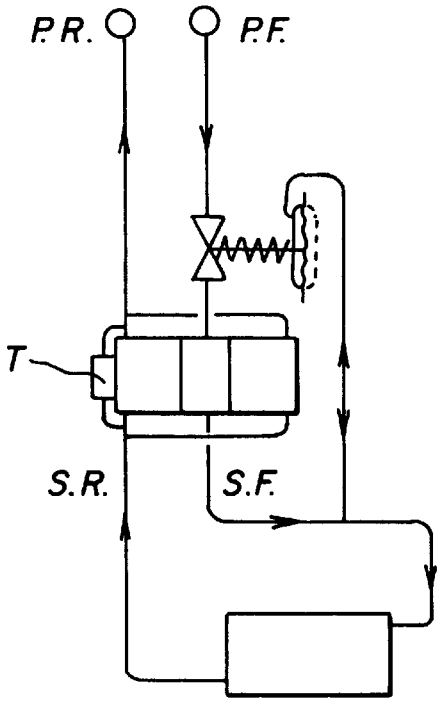

APPARATUS FOR USE IN LIQUID CIRCULATION SYSTEM AND METHOD FOR USING SAID APPARATUS

TECHNICAL FIELD

The present invention relates to an apparatus for use in a liquid circulation system, said system comprising a primary and a secondary liquid circulation circuit defining a primary forward flow, a primary return flow, a secondary forward flow and a secondary return flow.

BACKGROUND ART

In such systems, a need can arise to be able to operate with different pressures in the primary and secondary liquid circulation circuits, respectively, this normally being achieved by leading the primary liquid circulation circuit through a heat exchanger, and leading the secondary liquid circulation circuit through the heat exchanger separate from the primary circulation circuit by means of a pump. In addition to the possibility of operating with different pressures in the primary and secondary circuits, this arrangement also provides protection against liquid from the primary circulation circuit flowing out uncontrollably caused by a possible leak in the secondary circulatory circuit; this may be called for e.g. in district heating systems in order to protect against water damage. The heat exchanger will, however, introduce an undesired loss of heat, and will normally make it necessary to circulate the liquid in the secondary circulatory circuit by means of a circulation pump.

DISCLOSURE OF THE INVENTION

It is the object of the present invention to provide an apparatus, with which the disadvantages of the known separating systems based upon the use of heat exchangers described above are avoided, while at the same time making it possible to maintain different pressures in the primary and secondary liquid circulation circuits, respectively.

This object is achieved with an apparatus of the kind set forth mentioned above, according to the present invention exhibiting the arrangements of two positively interconnected displacement machines, one of which receives the primary forward flow and which delivers the secondary forward flow and the other of which receives the secondary return flow and delivers the primary return flow together with a flow equalization means whereby the volumetric effects of the displacement machines are attuned to each other in a manner to ensure that the volume flows in the primary forward flow, the secondary forward flow, the secondary return flow and the primary return flow are substantially equal.

By arranging the apparatus as set forth in claim 1 it is possible to have the same liquid circulate from primary forward flow to secondary forward flow, to secondary return flow and to primary return flow, without the pressure conditions in these flows necessarily being equal, because a pressure difference between these two liquid circulation circuits is exploited to supply power to one of the displacement machines, this machine then driving the other machine to pump the circulated liquid from the second to the first of these liquid circulation circuits whilst maintaining substantially equal flow volumes to and from the two circuits (primary and secondary, respectively) and without using a separate circulation pump for the secondary circulatory circuit, because the pressure difference between the primary forward flow and the primary return flow is utilized to create a pressure difference between the secondary forward flow and the secondary return flow.

The arrangement where the displacement machines act as a pump and a motor with the pump having a greater volumetric effect which is reduced by a pressure-controlled bypass means. This provides for an active balancing of the volume flows in the apparatus simultaneously with a control of the pressure on one side of the pump (delivery/inlet).

In especially preferred embodiments of the apparatus, in which the displacement machines are in the form of piston-cylinder units. By arranging these piston-cylinder units as two cylinders placed in a coaxial extension of each other the advantage is achieved that the seal between each piston and the associated cylinder solely has to withstand the prevailing differential pressure between a primary forward flow and return flow or a secondary forward flow and return flow, respectively, i.e. not the potentially substantially greater pressure difference between the primary and secondary circulatory circuit, in this arrangement being separated by means of the valve system or the central member, respectively.

One embodiment employs the utilization of the difference in volumetric effect for the inner and outer piston-cylinder pair, respectively, being "built-in" with this arrangement, so as to achieve the difference used of the volumetric effect for pressure control or attunement of the apparatus. A preferred dimensioning of the axial length of the pistons to match a stroke in the cylinders is made with a view to ensuring that the circulating forward-flow liquid does not exchange heat with the circulating return-flow liquid via the wall of the cylinder.

In specify preferred embodiments, the volumetric effects can be adjusted with high accuracy by means of the diameter on a piston-rod extension reducing the volumetric effect of the outer piston-cylinder unit.

In specify a preferred embodiment, the quantitative effect of the pump is greater than that of the motor, and in which the corresponding surplus amount is balanced out by means of a pressure-controlled return flow or by-pass flow.

In the preferred embodiments, the quantitative effect of the pump is less than that of the motor, and in which the corresponding surplus of liquid in the secondary circuit is drained via a pressure-controlled overflow or a pressure-controlled valve, respectively, or pumped back to the primary return flow by means of an auxiliary cylinder-piston unit, the control of the pumping-back operation possibly occurring via an expansion tank with a float-controlled valve.

Other embodiments specify various arrangements of the apparatus with which an adjustable volumetric effect is achieved.

Still other embodiment specify preferred arrangements of the seal between the pistons and the cylinders in the apparatus in the form of a rolling diaphragm, making it possible to achieve complete sealing, and which the hollow, toroid-shaped rolling diaphragm can provide a safe thermal insulation between the liquid on the forward-flow side and the liquid on the return-flow side.

Also specified are preferred methods for using the apparatus according to the invention, in which the use of displacement machines in the apparatus is exploited for measuring the volume flow in the system or for calorimetric measurements, respectively.

BRIEF DESCRIPTION OF THE DRAWINGS

In the following detailed portion of the present description, the invention will be explained in more detail with reference to the exemplary embodiments of the apparatus according to the invention shown in the drawings, in which.

DESCRIPTION OF THE PREFERRED EMBODIMENTS

Figure 1:
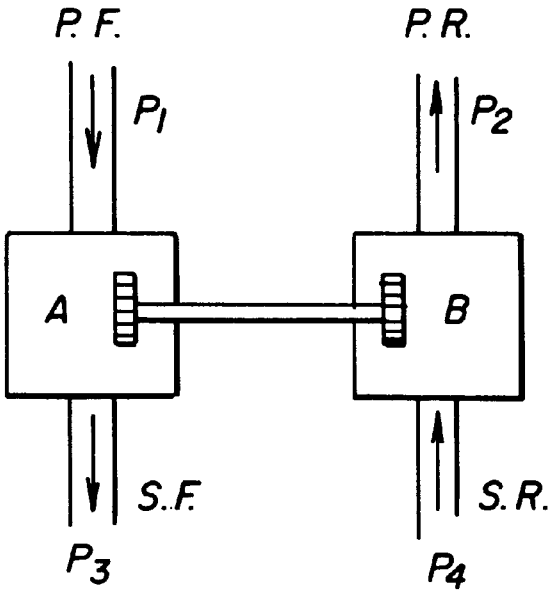
FIG. 1 is an overall diagrammatic sketch showing the apparatus according to the invention.

The apparatus according to the invention shown diagrammatically in FIG. 1 is connected through pipes to a primary forward flow P.F. with a pressure $P_1$ and a primary return flow P.R. with a pressure $P_2$, as well as to a secondary forward flow S.F. with a pressure $P_3$ and a secondary return flow S.R. with a pressure $P_4$, respectively. The pressures $P_1$ and $P_2$ in the primary forward flow and the primary return flow, respectively, are maintained with $P_1$ greater than $P_2$ by means of a circulation pump (not shown) in the primary circulatory circuit. The apparatus comprises a displacement machine A connected to receive the primary forward flow P.F. and deliver the secondary forward flow S.F., as well as a displacement machine B connected to receive the secondary return flow S.R. and deliver the primary return flow P.R. The volumetric effects of the displacement machines A and B are mutually attuned in such a manner that the volume flows in the four pipes are substantially equal. A prerequisite for the displacement machines to be active is that $P_1-P_3+P_4-P_2$ is greater than the pressure drop ($P_t$) arising in the displacement machines because of friction and losses in them. This may be re-written to read $(P_1-P_2)-P_t>(P_3-P_4)$, meaning that the pressure difference between primary forward flow and primary return flow is transferred to the secondary circulatory circuit to a pressure difference between the secondary forward flow and the secondary return flow by means of the interconnected displacement machines A and B shown.

If the apparatus is used in a district heating system, heating water will usually be circulated in the primary circulatory circuit with a primary forward-flow pressure $P_1$ of e.g. 5 bars and a primary return-flow pressure $P_2$ of e.g. 4 bars. Now, it is desirable to reduce these pressures in the secondary circulatory circuit to e.g. a secondary forward-flow pressure $P_3$ of 1 bar and a secondary return-flow pressure $P_4$ of 0.5 bar, thus reducing substantially the probability of leakage in the secondary circulatory circuit. In this situation, the displacement machine A functions as a motor and the displacement machine B as a pump, and if the displacement machine B has a greater volumetric effect that the displacement machine A, the displacement machine B will attempt to pump more liquid out of the secondary circulatory circuit than is being supplied via the displacement machine A, and this greater volumetric effect may then be compensated by means of a pressure-controlled by-pass T from the primary return flow to the secondary return flow, adapted to open when the pressure $P_4$ in the secondary return flow falls below e.g. 0.5 bar.

Additional control of the apparatus according to the present invention may be achieved by introducing a pressure-controlled or pressure-difference-controlled valve in the primary forward-flow line, e.g. adapted to be controlled by the pressure difference $P_3-P_4$, thus opening for primary forward flow when this pressure difference falls below an adjustable level.

In another application, the secondary circulatory circuit may e.g. comprise the supply of district heating to a high-level position (e.g. the uppermost floors in a tall building or a house situated at a level higher than the district-heating centre), and in this case, $P_1$ will be less than $P_3$ and $P_4$ be greater than $P_2$. In this situation, the displacement machine B functions as a motor and the displacement machine A as a pump. Then, the by-pass mentioned above must be placed between the secondary forward flow and the primary forward flow and adapted to open when the pressure $P_3$ in the secondary forward flow is greater than the forward-flow pressure required for circulating the liquid in the secondary circulatory circuit.

Figure 2:
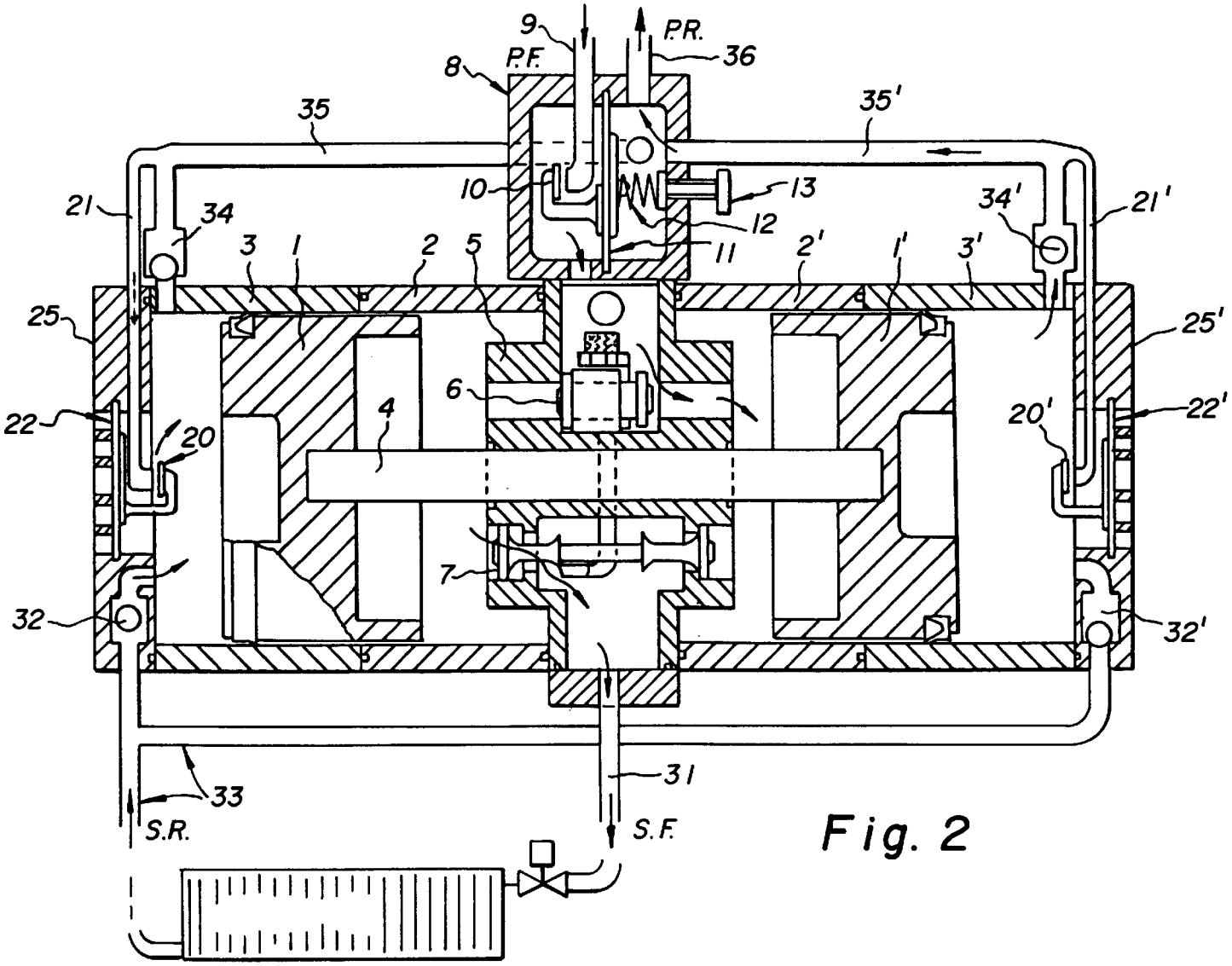
FIG. 2 shows in detail a first embodiment of the apparatus according to the invention.

The attention should now be directed to FIG. 2, showing a preferred embodiment of the invention, in which the displacement machines consist of two co-axially aligned cylinders 2, 3, 2', 3', each being subdivided into two parts by a piston 1 and 1', respectively, said pistons being mutually connected through a piston rod 4 extending in a fluid-tight manner through a stationary central wall 5 separating the two cylinders 2, 3 and 2', 3', respectively. The piston-cylinder pairs situated internally of the pistons 1, 1' constitute a displacement motor, the operation of which is controlled by valves 6, 7 situated in the central wall 5 and having their valving functions controlled by the movements of the pistons 1, 1' in the cylinders 2, 3, 2', 3'. The apparatus is connected to a primary forward flow 9 and a primary return flow 36 as well as a secondary forward flow 31 and a secondary return flow 33, in this Figure being imagined as a district-heating system with radiators for domestic heating purposes in the secondary circulatory circuit. In the embodiment shown in FIG. 2, the supply pressure to the displacement motor is controlled by a valve 10 adapted to open when the pressure difference between the inlet to the displacement motor and the primary return flow falls below a predetermined level, said level being set by means of an adjustment screw 13 and a spring 12 and controlled by a diaphragm 11. In this system, the displacement pump is constituted by the piston-cylinder units situated outside of the pistons 1, 1'. The operation of the pump is controlled by non-return valves 32, 34, 32', 34'. In the position of the valves 6, 7 shown in FIG. 2, the circulating liquid flows from the primary forward flow 9 via the valve 10 and the valve 6 to the rear side of the piston 1', the latter moving towards the right and thus causing circulating liquid to flow through the valve 7 to the secondary forward flow 31. Secondary-return-flow liquid from the line 33 flows via the non-return valve 32 to the external side of the piston 1, which moves to the right, and liquid on the external side of the piston 1' flows via the non-return valve 34' to the line 35' and via the pressure-difference regulator to the primary return flow 36. Due to the piston rod 4, the volumetric effect of the displacement motor constituted by the piston-cylinder units situated internally of the pistons 1, 1' is less than the volumetric effect of the displacement pump constituted by the piston-cylinder unit situated outside of the pistons 1, 1'. This greater volumetric effect is compensated by means of valves 20, 20', in the embodiment shown in FIG. 2 controlled by the difference in pressure between the piston-cylinder unit of the pump and the atmosphere, because when the pressure outside of the piston 1 falls below atmospheric, the diaphragm 22 opens the valve 20 and allows return flow of circulating liquid from the primary return flow in the line 35 via the line 21. When the pistons 1, 1' have reached their extreme right-hand position, the valves 6, 7 are switched by means of a mechanism not shown in detail, said mechanism being adapted to switch the valves substantially instantaneously, so that subsequently, the inflow of circulating liquid from the primary forward flow occurs internally of the piston 1, and the outflow of circulating liquid to the secondary forward flow occurs from internally of the piston 1', causing the pistons 1, 1' to move toward the left. This will also cause switching of the displacement pump externally of the pistons 1, 1', as the non-return valve 32 closes and the non-return valve 32' opens, and correspondingly the non-return valve 34 opens and the non-return valve 34' closes, and the pressure control previously carried out by the diaphragm 22 and the valve 20 is now transferred to the diaphragm 22' and the valve 20'. A corresponding switching occurs in the opposite extreme position of the pistons 1, 1'. The diaphragms 22, 22' can, of course, be provided with suitable springs and adjustment devices in order to adjust the pressure, at which the return flow from the primary return line is opened for.

Figure 3:
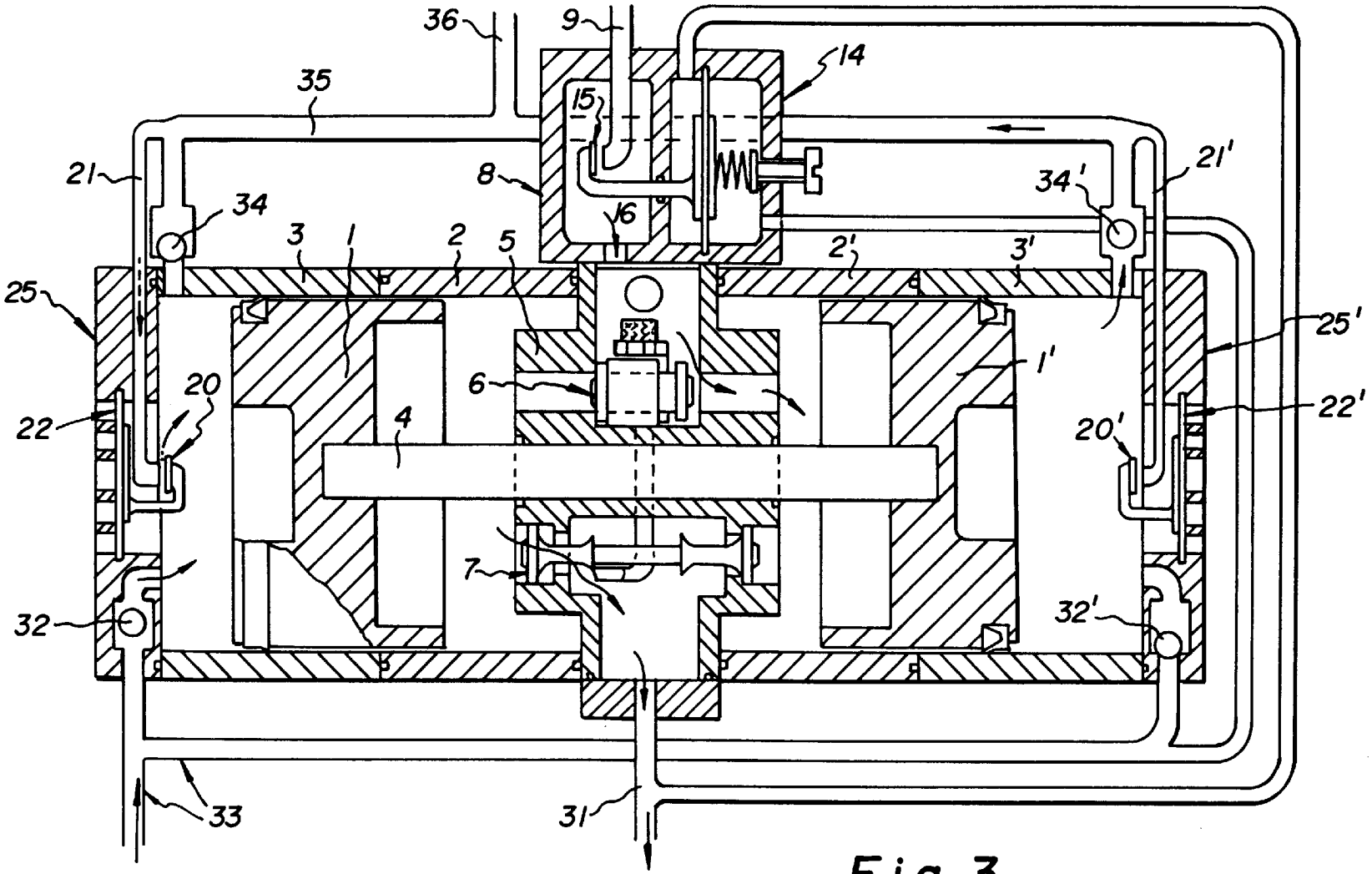
FIG. 3 shows a second embodiment.

The embodiment of the apparatus shown in FIG. 3 is substantially identical to the one shown in FIG. 2 with the exception of the arrangement of a pressure-difference sensor 14. This pressure-difference sensor controls the opening of the primary-forward-flow valve 15 on the basis of the difference in pressure between the secondary return flow 33 and the secondary forward 31, each acting upon a respective side of the diaphragm situated in the housing of the pressure-difference sensor 14, this diaphragm again controlling the opening of the valve 15. Further, the diaphragm is acted upon by a spring, the effect of which may be adjusted by means of an adjustment screw.

Otherwise, the embodiment shown in FIG. 3 operates in the same manner as the one described above with reference to FIG. 2.

Figure 4:
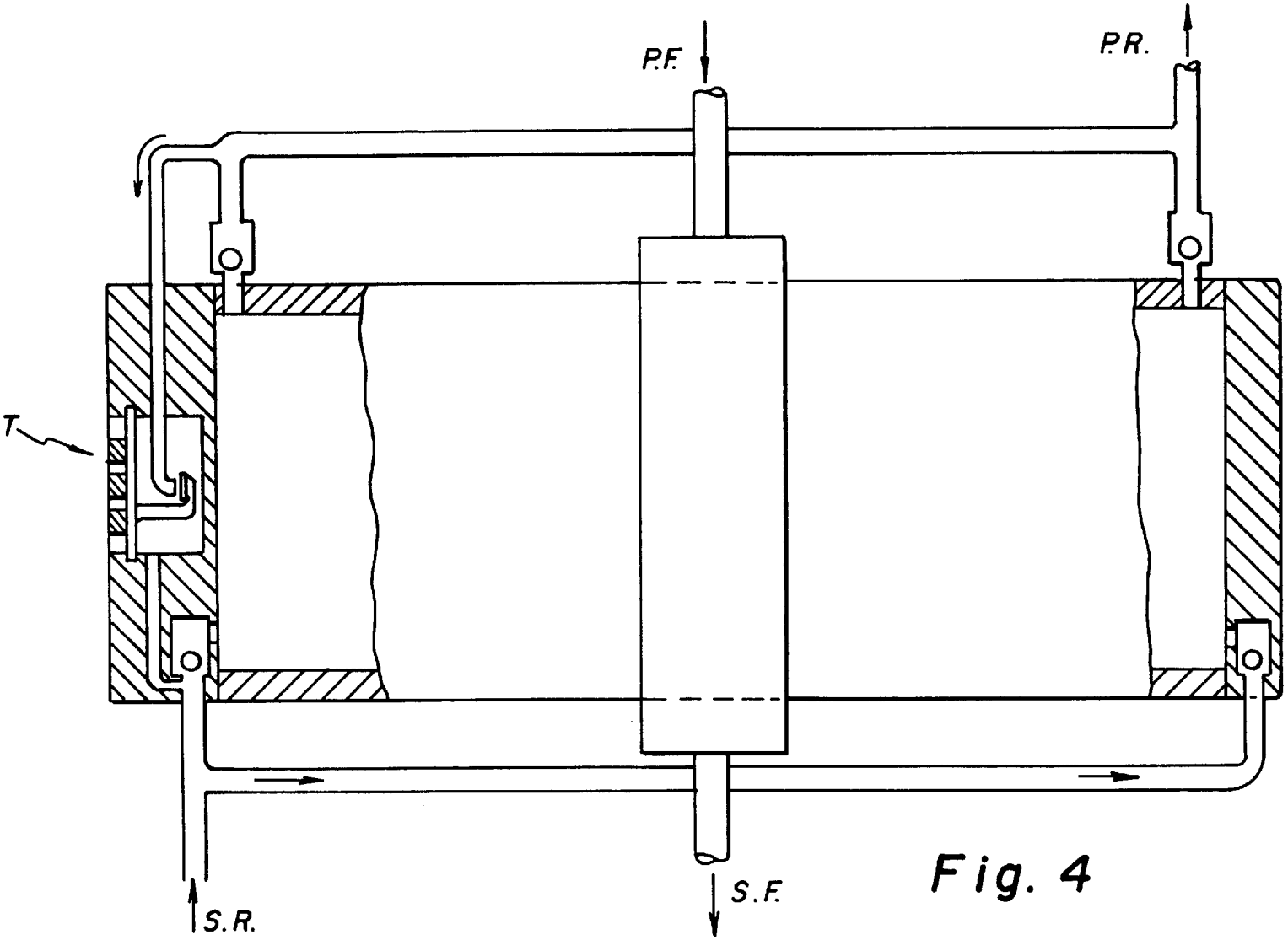
FIG. 4 shows a variant of the embodiments shown in FIGS. 2 and 3, FIGS. 5–10 show various applications of the apparatus according to the invention.

FIG. 4 shows an embodiment in which the bypass valves of FIGS. 2 and 3 have been moved so as to allow bypass flow directly from the primary return flow to the secondary return flow bypassing the non-return valves 32, 32', so that it is sufficient to use a single bypass valve T as distinct from the two bypass valves 20, 20', 22, 22' as in the FIGS. 2 and 3.

FIGS. 5–10 show a series of examples of the use of the apparatus according to the invention, all to be explained in more detail below.

Figure 5:
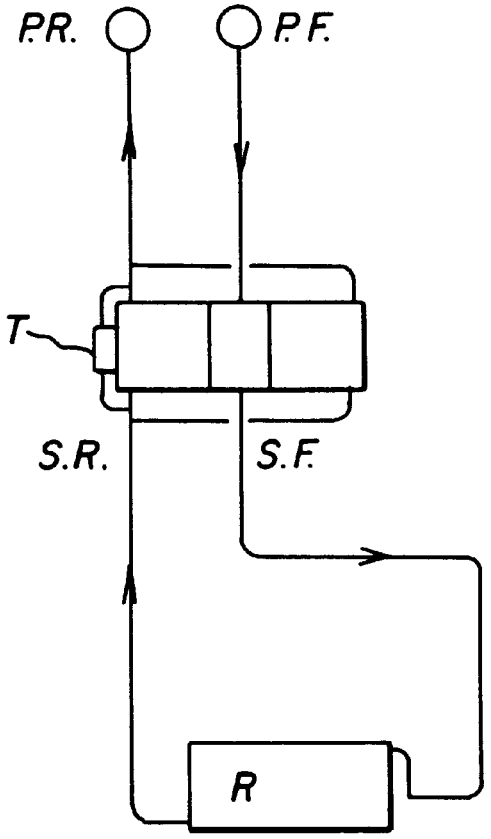

FIG. 5 shows the apparatus in operation in connection with a district-heating system, in which the pressure in the secondary return flow is regulated by means of the bypass valve T, e.g. to be sub-atmospheric, so that a possible leak in the secondary circulatory circuit will not cause water to flow out, but rather air to be aspirated into the secondary circulatory circuit. In the example shown in FIG. 5, the primary forward flow and the secondary forward flow are connected to the displacement motor and the secondary return flow and the primary return flow are connected to the displacement pump, all corresponding to FIGS. 2 and 3.

FIG. 6 shows the apparatus according to the invention being used to reduce the pressure in the water being circulated in a heat exchanger C with a view to ensuring that the liquid circulating in the secondary circulatory circuit does not penetrate into the liquid circulating on the other side of the heat exchanger C, such as water for domestic use that should not be contaminated with the liquid circulating in the primary and secondary circulatory circuits. In the arrangement shown in FIG. 6, the pressures in the secondary circulatory circuit are maintained lower than the pressure in the domestic-water circuit on the other side of the heat exchanger C, the bypass T ensuring that the pressure in the secondary return flow is held at a suitably low level. In this arrangement, there is no need for a pressure regulator, as long as the pressure difference between the primary forward flow and the primary return flow is lower than the pressure in the domestic water on the other side of the heat exchanger C.

In the application shown in FIG. 7, the arrangement according to FIG. 5 has been supplemented with a pressure-regulating valve P ensuring that the pressure in the secondary forward flow downstream of this valve does not exceed a preset pressure, such as could occur with the embodiment according to FIG. 5, if minor leaks are present in connection with valves and pistons in the apparatus according to the invention, and there is no movement, i.e. when there is no flow through the apparatus.

FIG. 8 shows another arrangement of the pressure control in the secondary forward flow, in which the inflow to the displacement motor is controlled by a valve adapted to open for the inflow when the pressure in the secondary forward flow falls below a predetermined level, e.g. atmospheric pressure.

In FIGS. 5–8, the apparatus according to the invention is shown diagrammatically, showing the primary forward flow to be supplied to the displacement motor delivering the secondary forward flow, and the secondary return flow flows into the displacement pump delivering the primary return flow.

Figure 9:
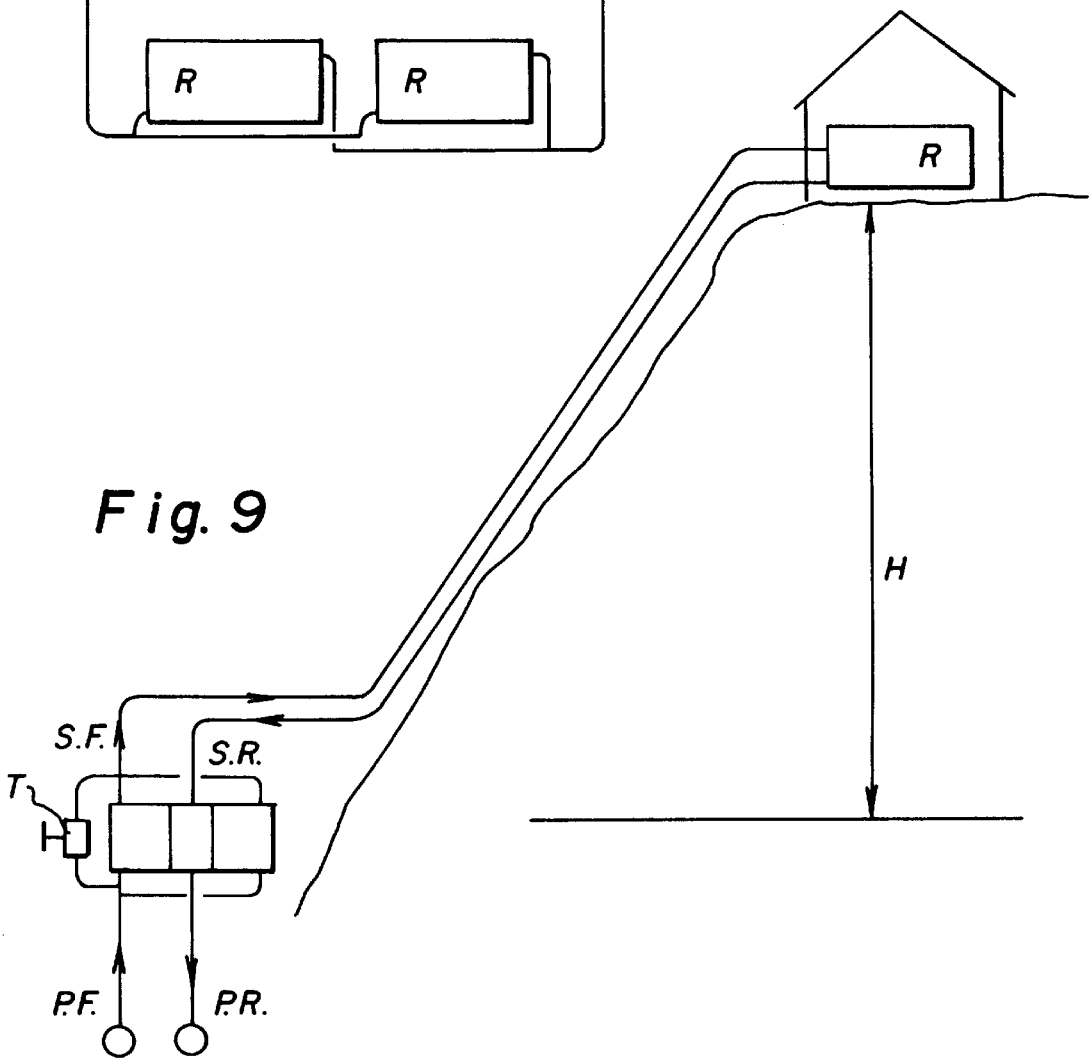

In the application shown in FIG. 9, the primary forward flow is supplied to the displacement pump delivering the secondary forward flow, while the secondary return flow is supplied to the displacement motor delivering the primary return flow. In this embodiment, the apparatus according to the invention is used to increase the pressure in the secondary circulatory circuit, so that the latter is able to circulate the liquid to an elevated level as indicated by the house on the hilltop. In this situation, the bypass valve T is placed so as to allow circulating liquid to flow back from the secondary forward flow to the primary forward flow when the pressure in the secondary forward flow increases beyond a predetermined level, the latter being adjusted by means of the bypass valve and corresponding to the pressure head desired (the head H as measured to the house on the hilltop).

If the apparatus is constructed in the manner shown in FIG. 2 with the exception of the pressure-difference-controlled valve 10 etc., it will be seen that the valve mechanism of the displacement motor is placed in the cold return line and only the simple non-return valves are placed on the hot side, this being advantageous with this application.

Figure 10:
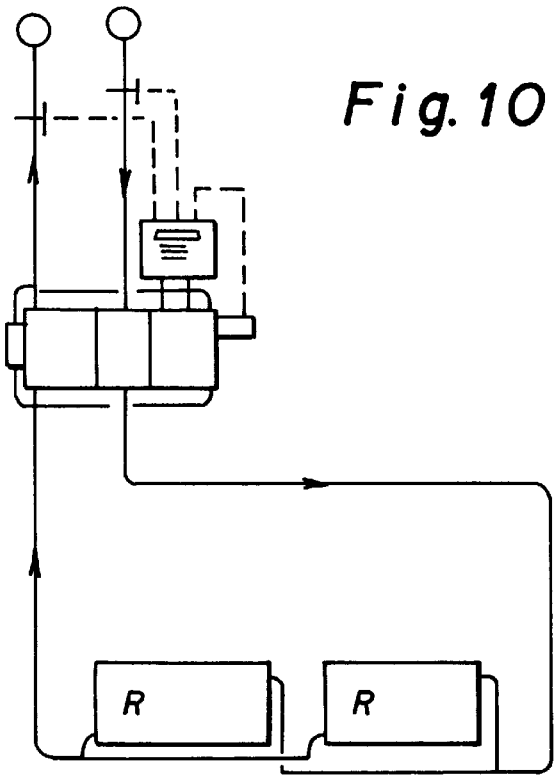

FIG. 10 shows an application fully corresponding to that of FIG. 5, but in which the displacement machines constructed substantially in the manner shown in FIG. 2 are used additionally to deliver impulses to a calorie counter for each cycle of the displacement machines, thus delivering impulses to the calorie counter in a number proportional to the volume of the circulated liquid. Further, the calorie counter receives signals from a set of temperature sensors placed in the primary forward flow and the primary return flow, respectively, but the associated temperature sensors may, of course, be placed internally in the apparatus (the displacement machines).

Figure 11:
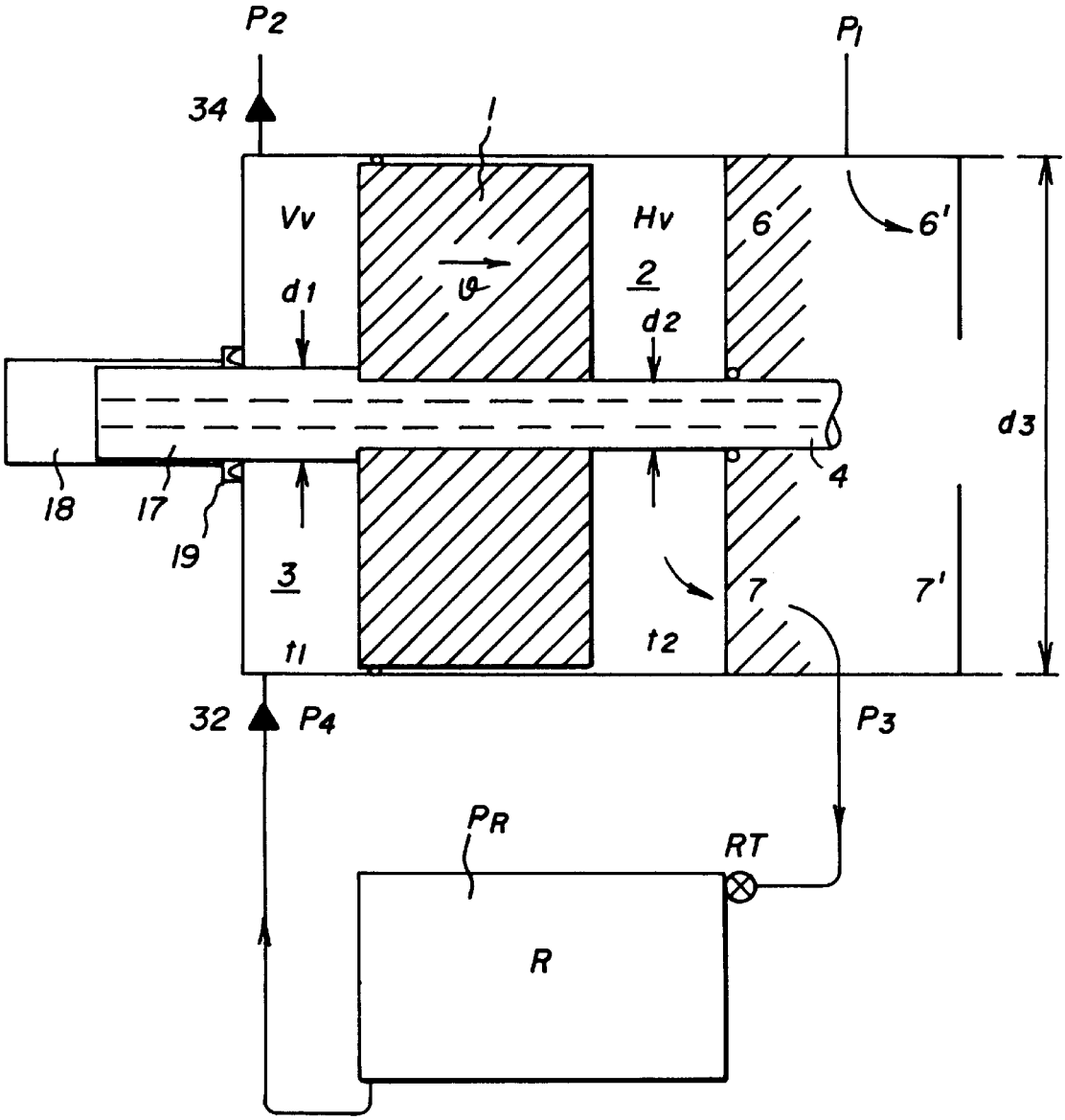
FIG. 11 is a sketch showing a variant of the apparatus according to the invention.

Because the circulating liquid is usually water, in the radiator system R being cooled from e.g. 80° C. to 40° C., an increase in the specific weight of the liquid will occur. In order to compensate for this increase in specific weight, the volumetric effect of the pump pumping liquid from the return line in the secondary circulatory system to the return line in the primary circulatory system must be reduced corresponding to this increase in specific weight. In FIG. 11, this reduction is provided by means of a piston-rod extension 17 co-operating with an auxiliary cylinder 18, the latter being sealed relative to the piston-cylinder unit 1, 3 by means of a lip seal 19. The diameter $d_1$ of the piston-rod extension 17 is greater than the diameter $d_2$ of the piston rod 4, so that the volumetric effect of the piston-cylinder unit 1, 3 acting as a pump is less than that of the piston-cylinder unit 1, 2 acting as a motor. In the embodiment shown in FIG. 11, the auxiliary cylinder 18 is connected to the corresponding auxiliary cylinder 18' in connection with the piston 1' via a bore in the piston rod 17, 4, 17' connecting the two cylinders 18, 18'. In this manner, the pressure between the cylinders 18 and 18' is equalized, so that these cylinders are "idling". By suitably dimensioning the diameters $d_1$ and $d_2$ as well as the diameter $d_3$ of the main cylinders 2, 2' 3, 3', it is possible, when cooling the circulating liquid in a known manner from a temperature $t_2$ to a temperature $t_1$, to achieve a well-defined balance between the quantity of liquid being supplied to the secondary circulatory system via the secondary circulatory forward flow and the quantity of liquid being removed from the secondary circulatory system via the secondary circulatory return flow.

Figure 12:
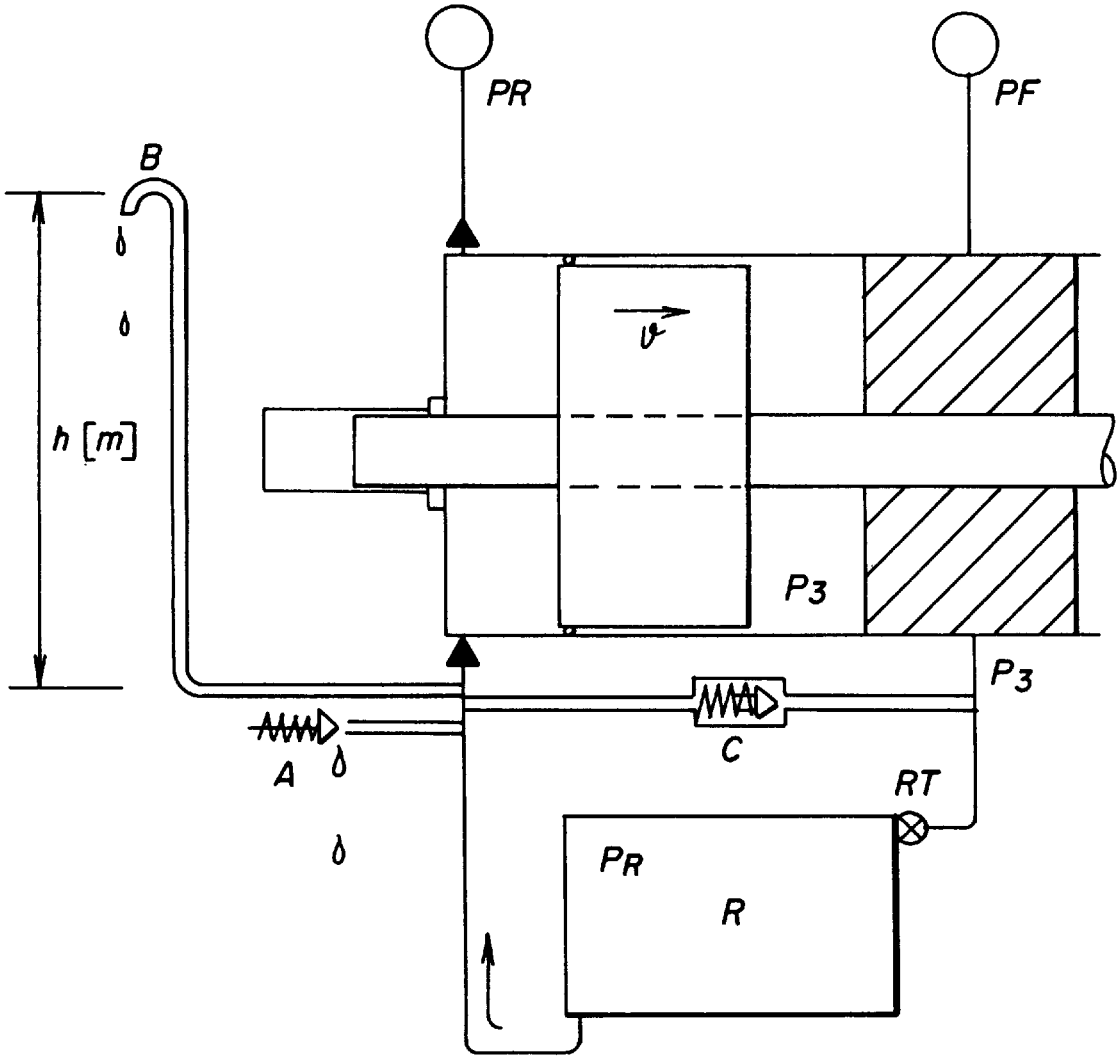
FIGS. 12–15 show various pressure-control means for use in connection with the apparatus according to the invention.

If the quantity of liquid being pumped to the secondary circulatory system is greater than the quantity of liquid being pumped from the secondary circulatory system, there will be a need for controlling the maximum pressure in the secondary circulatory system that can be provided, as shown in FIG. 12, in which an overflow B with a certain rise head h [m] ensures that the surplus quantity is allowed to drip out at B. Alternatively, an excess-pressure valve A may correspondingly allow the surplus quantity to drip away at A, the pressure possibly being adjustable by means of a spring in the excess-pressure valve A.

If the seals between the pistons 1, 1' and the associated cylinders 2, 2', 3, 3' are so constructed that they cannot withstand a too high pressure, the pressure difference between $P_3$ and $P_4$ may be limited by means of a safety valve C as shown in FIG. 12.

Figure 13:
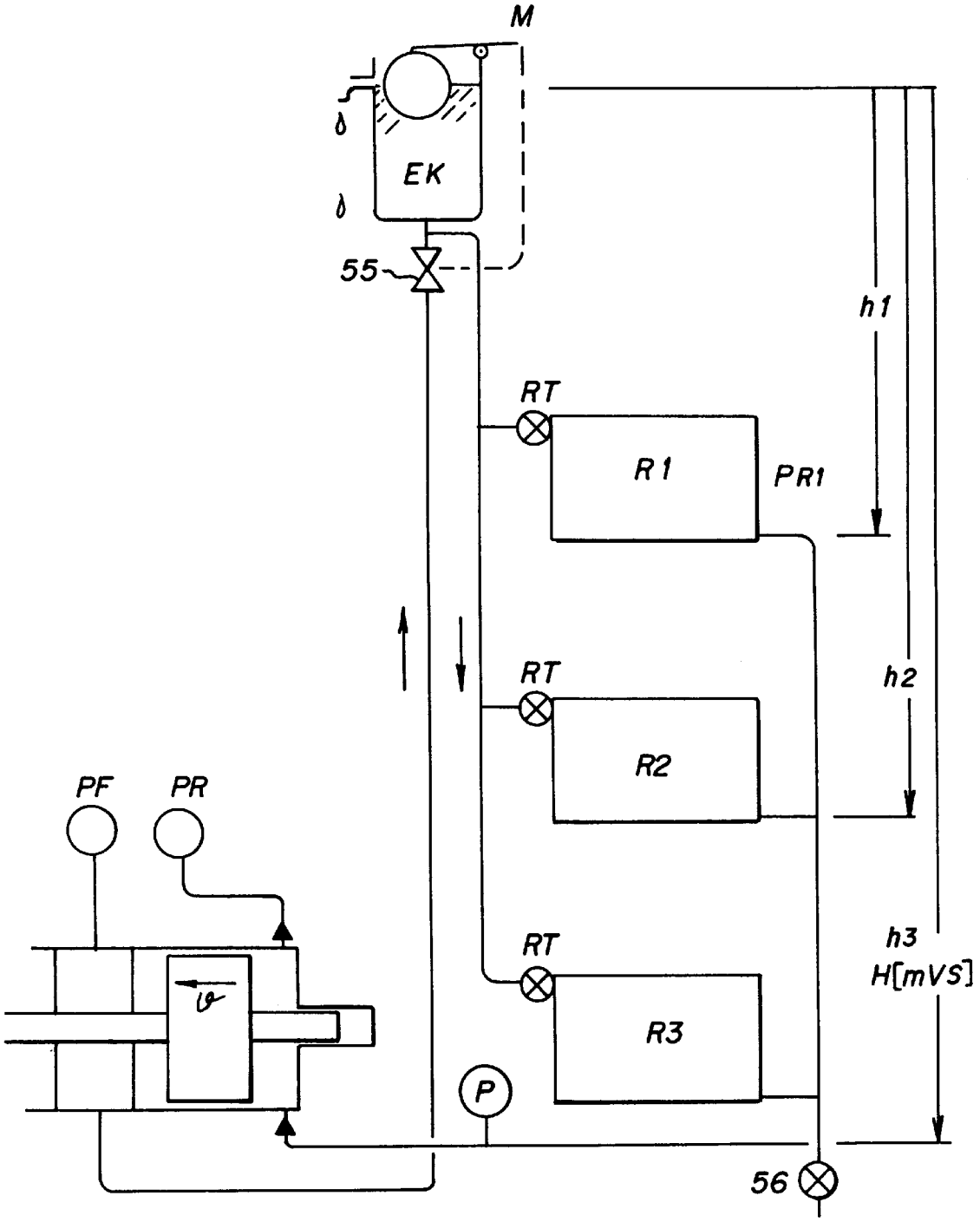

FIG. 13 shows an alternative arrangement of the overflow system in connection with a multi-storey radiator system R1, R2 and R3. This overflow system comprises an expansion tank EK, in the embodiment shown placed in the secondary forward-flow line and provided with a signaller M, which in case of leaks in the radiator system R1, R2 and R3 detects a fall in the level of liquid in the expansion tank EK and controlled by this fall closes a valve 55 in the forward-flow line, so that liquid is no longer supplied to the radiator system R1, R2 and R3. Additionally, the radiator system may possibly be emptied of liquid via a further valve 56, through which the liquid is drained from the radiator system R1, R2 and R3 to an outlet. This arrangement prevents water damage in case of leaks in the radiator system R1, R2, R3.

The system shown in FIG. 13 is especially suitable for multi-storey buildings, in which the radiators R1, R2, R3 are situated in different storeys and thus subjected to different pressures corresponding to the pressure heads $h_1$, $h_2$ and $h_3$ as shown.

As an alternative to the level sensing by the signaller M, the detection of the falling liquid level in the expansion tank EK may be provided by means of a pressure gauge P in the return-flow line of the secondary circulatory system.

Figure 14:
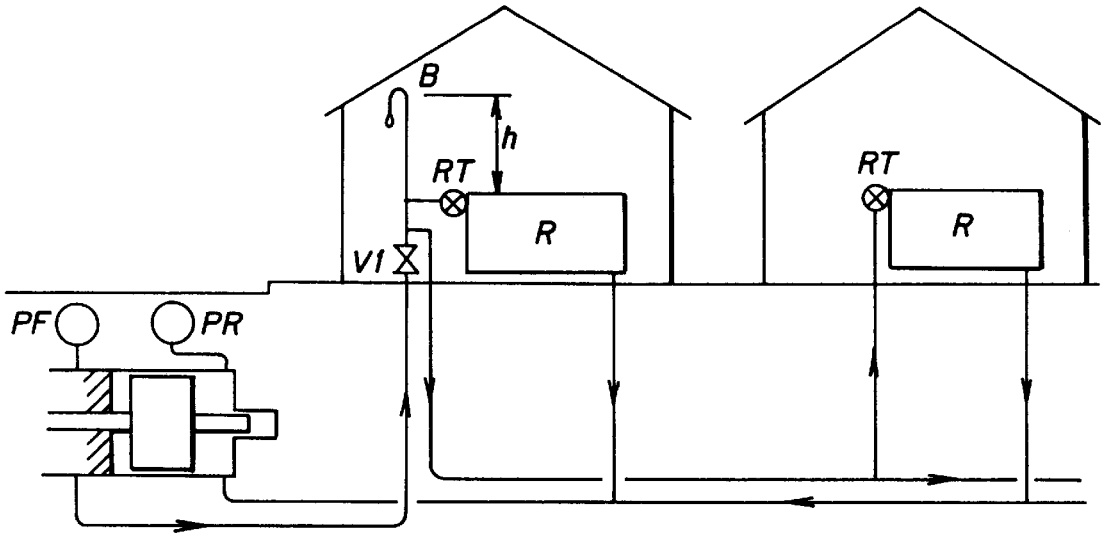

FIG. 14 shows diagrammatically a system corresponding to that of FIG. 12, but with a number of houses being supplied from a common displacement-machine unit and provided with a single overflow only. In the case of a breakage in the system causing the liquid pressure in the secondary circulatory system to fall, the valve Vi will interrupt the supply of liquid to the radiator system.

Figure 15:
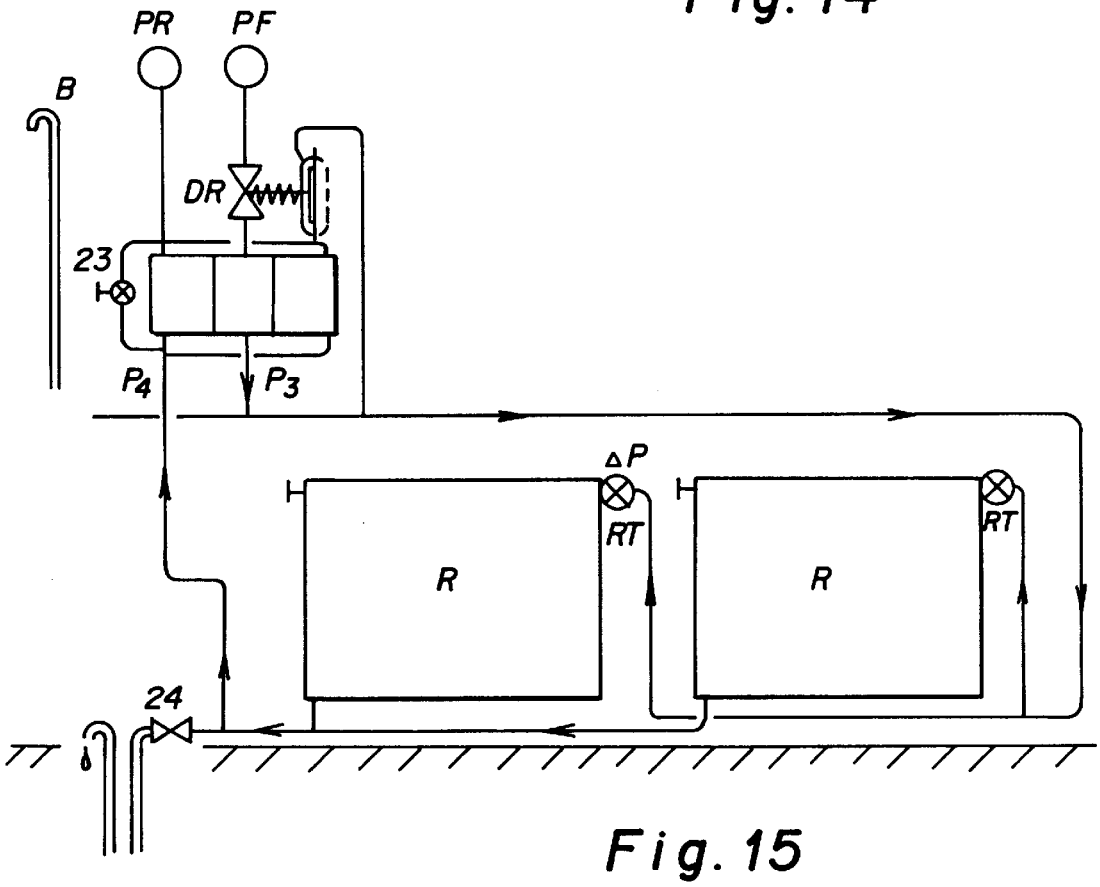

FIG. 15 shows an alternative system for controlling the pressure in the radiator system R. The secondary forward-flow pressure $P_3$ is controlled by means of the pressure-difference-control valve DR to be identical to atmospheric pressure. As the displacement machines are constructed to supply more liquid to the secondary circulatory system than is removed from this system, this surplus quantity will drip out from the system via the valve 24 and a floor drain. Because the dripping-off occurs at floor level, the pressure in the return flow of the secondary circulatory system is maintained identical to the pressure at this floor drain, so that the pressure in the radiators R lies below atmospheric pressure. Thus, a possible leak in a radiator R will cause air to be drawn into the radiator and the corresponding quantity of liquid to drip out via the floor drain. In order to prevent a possible rise in the pressure $P_3$, the forward flow of the secondary circulatory system is provided with an overflow B at a suitable level. With a view to making it possible to bleed air from the radiators R a set of valves 23, 24 are provided, and when bleeding is to be carried out, the valve 24 is closed and the valve 23 is opened to allow the pressure of the primary return flow to reach the radiators enabling them to be bled by means of this pressure, the maximum pressure, however, being limited by the overflow B, and after the bleeding operation, the valve 23 is closed and the valve 24 opened for normal operation as described above.

Figure 16:
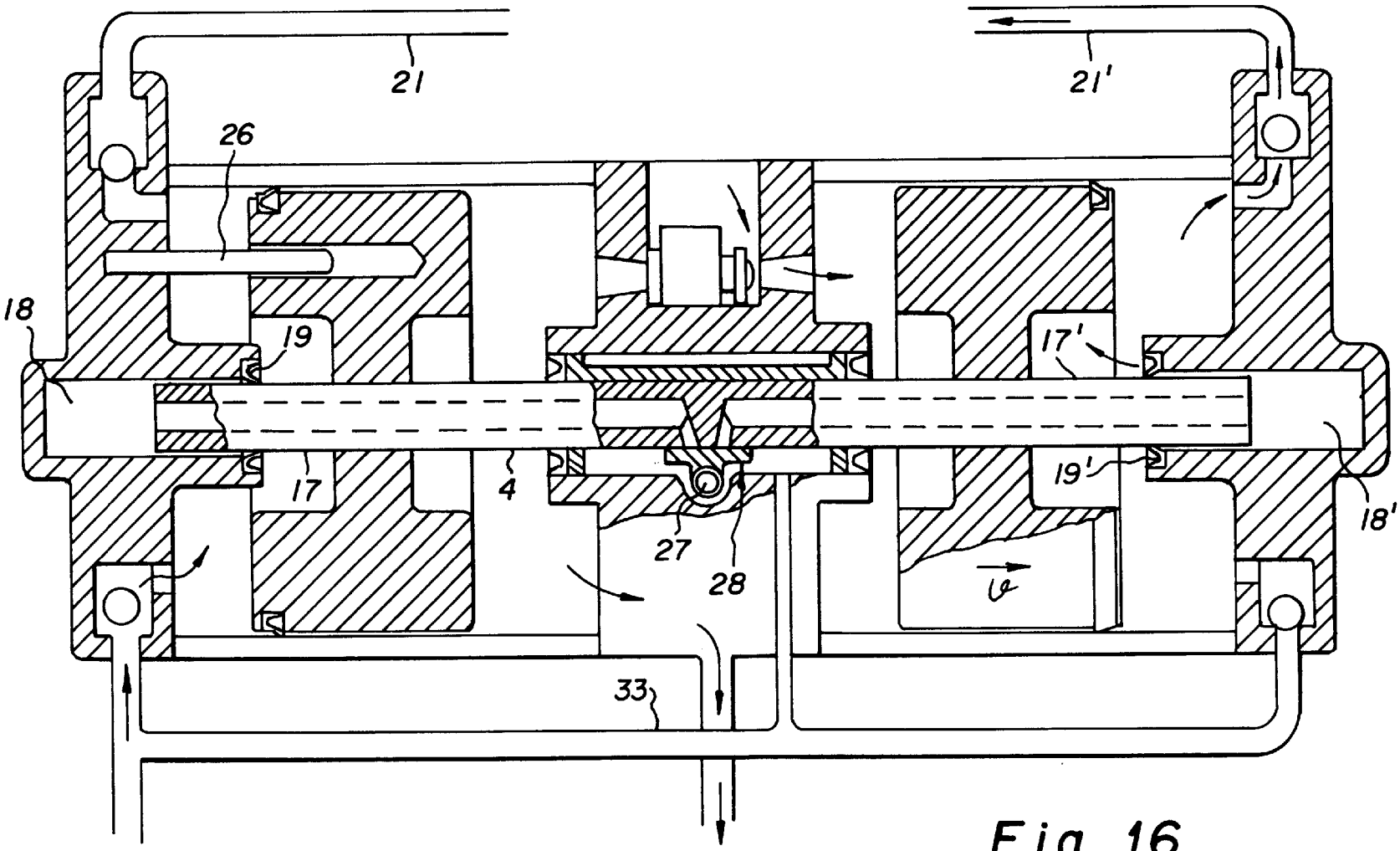
FIGS. 16 and 17 show various arrangements of the apparatus according to the invention with which an adjustable volumetric effect is achieved.

FIG. 16 shows an alternative embodiment of the displacement machines shown in FIG. 11 in which it is possible to adjust the volumetric effect for the externally situated piston-cylinder units 1, 1', 3, 3'. The adjustability is provided by supplementing the effect of the externally situated piston-cylinder unit with the effect of the auxiliary piston-cylinder units 17, 18, 17', 18' along a certain length of the path of movement of the pistons. The length of the movement, in which the volumetric effect is supplemented with that of the auxiliary piston-cylinder units, is adjusted by means of a sleeve 28 adapted to close transverse bores into each of the central bores in the piston rod along a certain length of the movement of the piston rod, so that the auxiliary piston-cylinder units 17, 17', 18, 18' will pump liquid past the lip seals 19, 19' when these transverse bores are closed and the associated cylinder 18 or 18' is under compression. The liquid is supplied to the auxiliary piston-cylinder unit 17, 17', 18, 18' from the secondary return flow 33 via a tube to the central wall 5, in which the sleeve 28 is situated. The sleeve 28 has a V-shaped cut-out, so that rotation of the sleeve will provide a greater or lesser coverage of the transverse bores in the piston rod 4. The piston rod is held against rotation in order to ensure a constant position of these transverse bores by means of a guide pin 26 that is secured to the end wall and co-operates with a bore in the piston 1.

Figure 17:
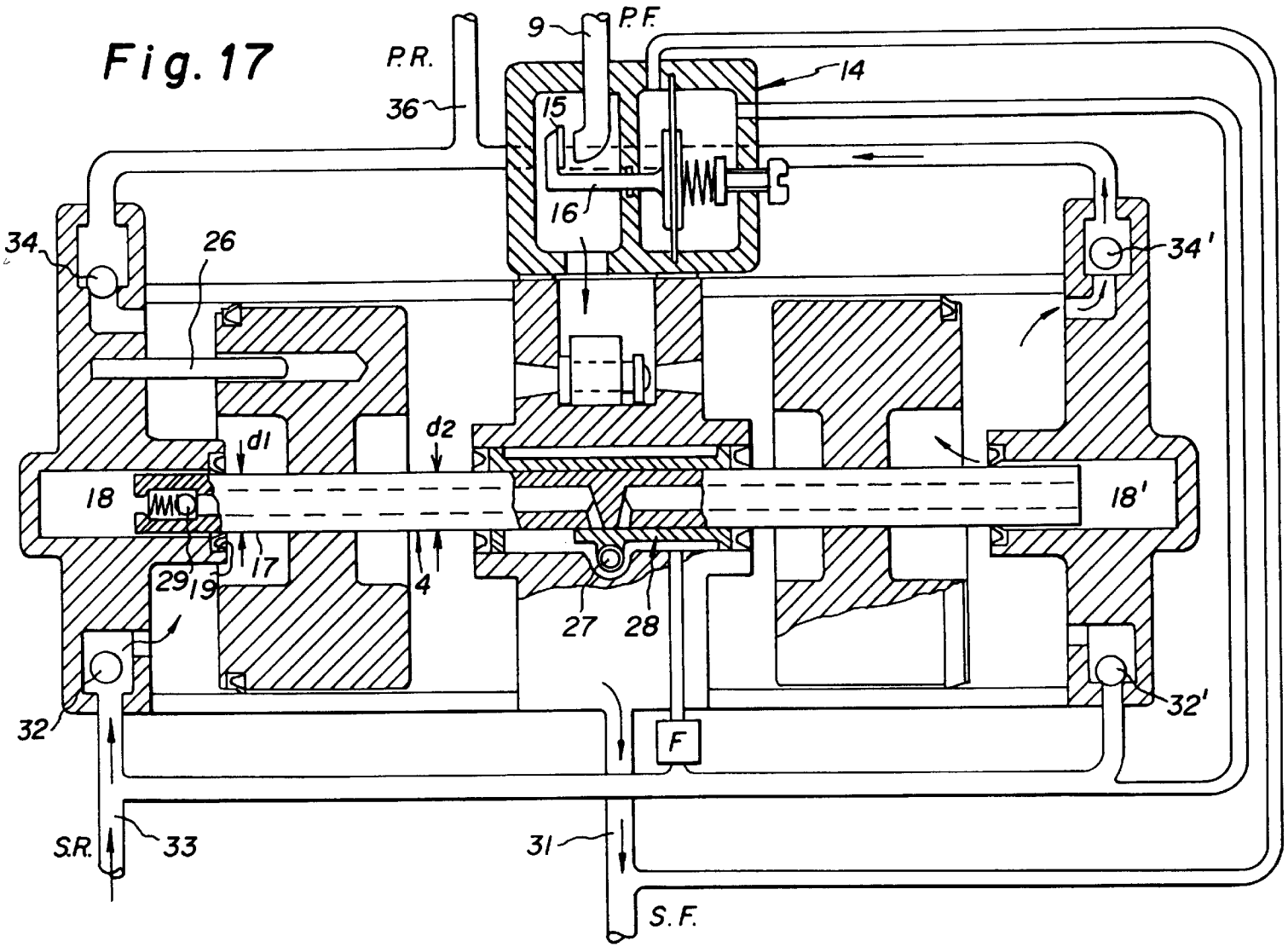

FIG. 17 shows an alternative embodiment of such an arrangement with adjustable volumetric effect, in which only one auxiliary piston-cylinder unit 17, 18 is used to supplement the volumetric effect of the pump unit. In this arrangement, secondary return-flow liquid is pumped from the line 33 via a transverse hole in the piston rod 4, which hole during part of its movement is covered by the sleeve 28, the latter again having a V-shaped cut-out and being rotatable by means of an adjusting screw 27. Thus, liquid is supplied to the auxiliary piston-cylinder unit 17, 18 via the transverse bore in the piston rod 4 and the central bore in the latter, a non-return valve 29 ensuring that the liquid only flows to wards the cylinder 18. During the compression stroke in the auxiliary cylinder 18, liquid will be forced past the lip seal 19 and to the primary return flow via the main cylinder and the non-return valve 34. The other auxiliary piston-cylinder unit 17', 18' may be used for return pumping of surplus liquid, to be explained below.

Figure 18:
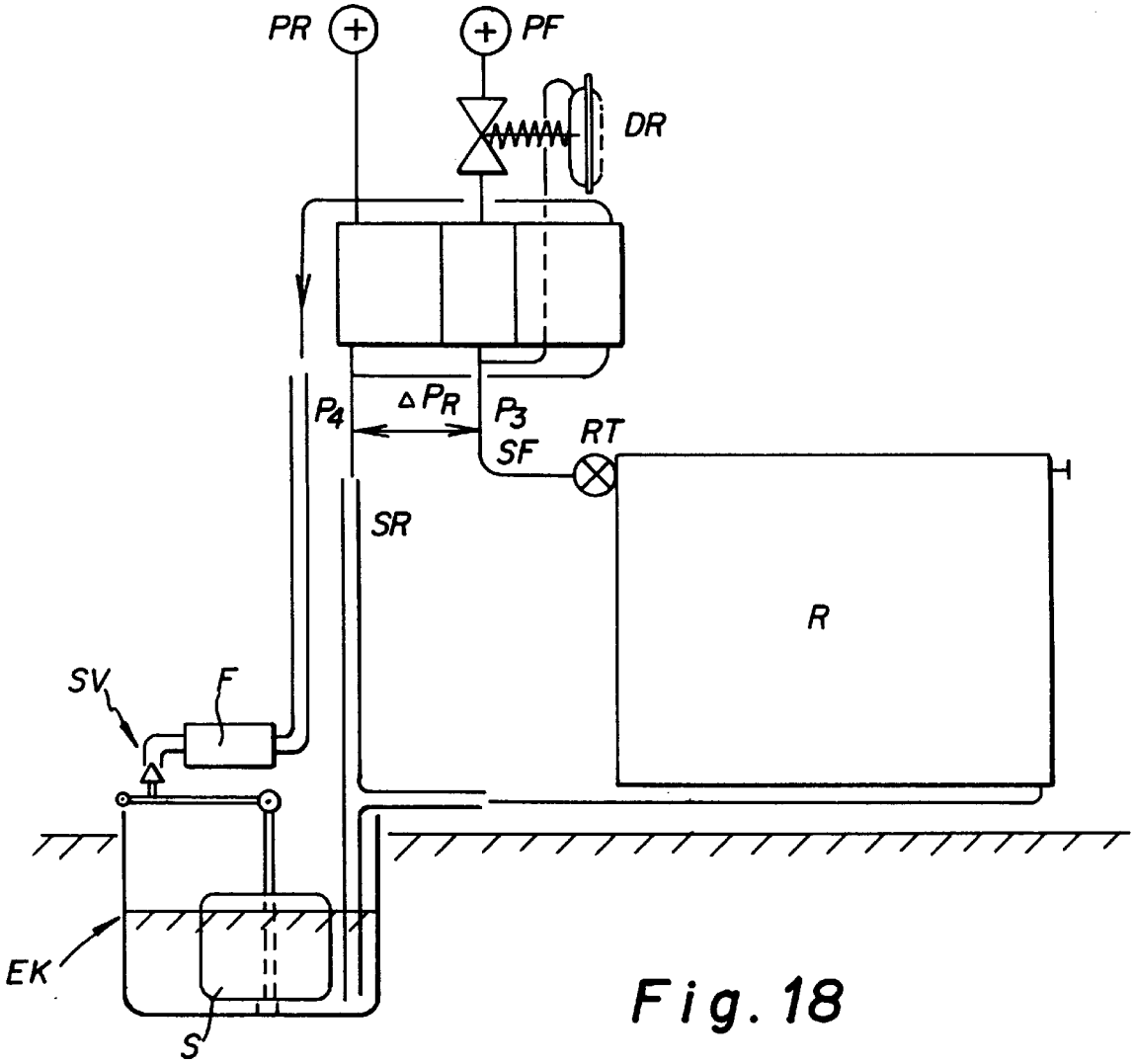
FIG. 18 shows yet another possible arrangement of pressure-control means.

FIG. 18 shows an alternative embodiment of a bypass flow in association with a displacement machine, in which more liquid is pumped away from the secondary circulatory system than is supplied to it. This bypass flow comprises a float-control bypass valve SV allowing liquid from the primary return flow to flow to an expansion tank EK, in which is placed a float S for controlling the float valve SV. When the liquid level in the expansion tank EK falls, the flow valve SV will open for bypass flow of liquid from the primary return flow to the expansion tank, from which the liquid is pumped via the secondary return flow and the pump part of the displacement machine. In FIG. 18 the expansion tank EK is shown placed at a level lower than the radiator R, so that the pressure in the radiator R will be below atmospheric. Alternatively, the expansion tank EK may be placed at a higher level, e.g. in connection with multi-storey buildings, in which it is necessary to prevent the pressure in the radiators from being too low, in order to avoid the formation of steam in them. In FIG. 18 the secondary forward-flow pressure $P_3$ is controlled by a pressure-difference-control valve DR. In the case of a leak in the radiator R in FIG. 18 air will be aspirated via the leak, and the radiator R will be emptied into the expansion tank EK, from which the liquid will be pumped back to the primary circulatory system by means of the displacement machine.

A possible overflow from the expansion tank EK may be conducted to an outlet or a drain.

Figure 19:
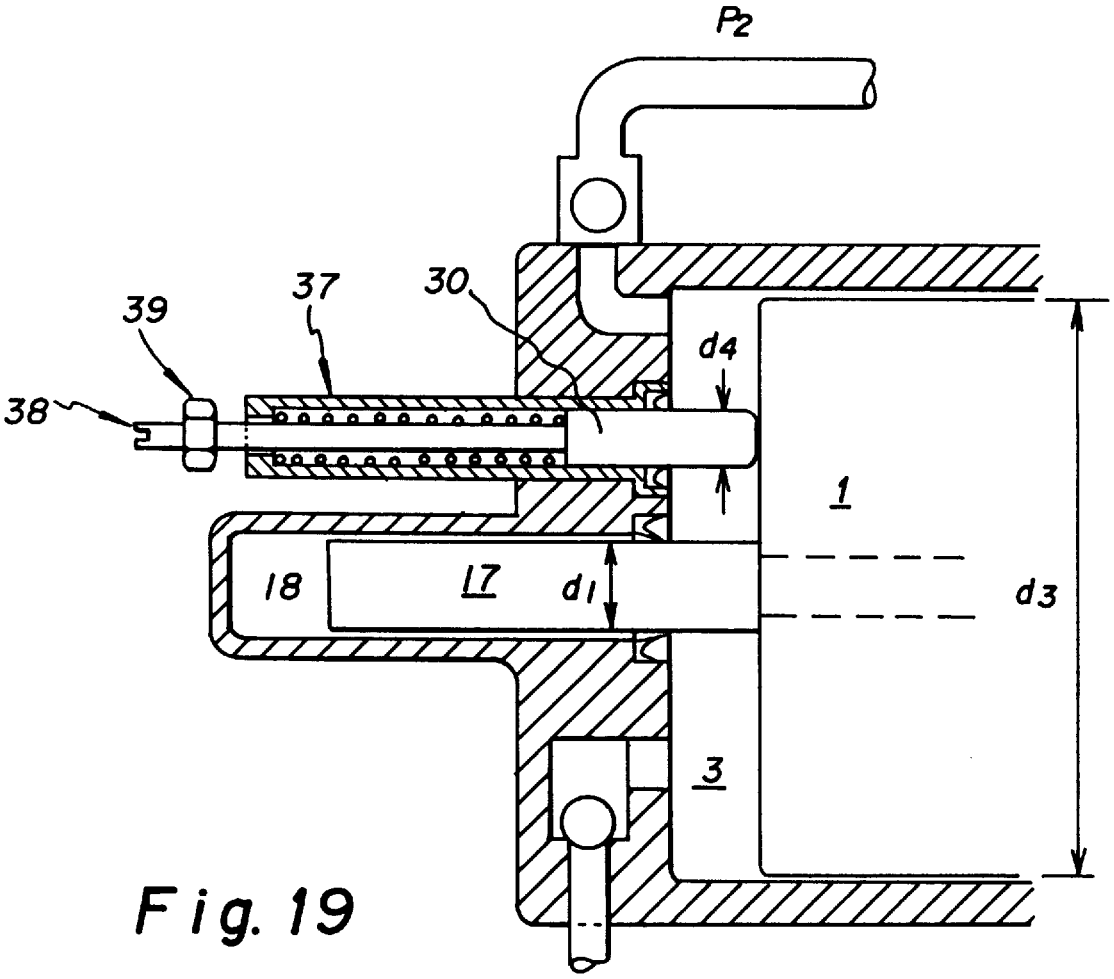
FIGS. 19 and 20 show additional possible ways of providing an adjustable volumetric effect.

FIG. 19 shows an alternative possibility for adjusting the volumetric effect of the pump section. Primarily, the volumetric effect is set slightly higher than desired by means of the diameters $d_1$, $d_2$ and $d_3$ corresponding to what is shown in FIG. 11. The volumetric effect of the piston-cylinder unit 1, 3 is reduced by means of an auxiliary piston 30 moving together with the piston 1 through the final part of the latter's movement while liquid is being pumped out to the primary return flow, as well as through the initial part of this piston movement while liquid is being pumped in from the secondary return flow. The auxiliary piston 30 has a diameter $d_4$ and reduces the volumetric effect of the piston 1 in the cylinder 3 with the corresponding area through the movements of the piston 30, this movement being adjusted by means of an adjusting screw 38 with associated locking nut 39, so that the extent to which the piston 30 penetrates into the cylinder 3 is adjustable, and the piston 30 moves to the left by the action of the piston 1 and moves to the right by means of a spring 37, all as shown in FIG. 19.

Figure 20:
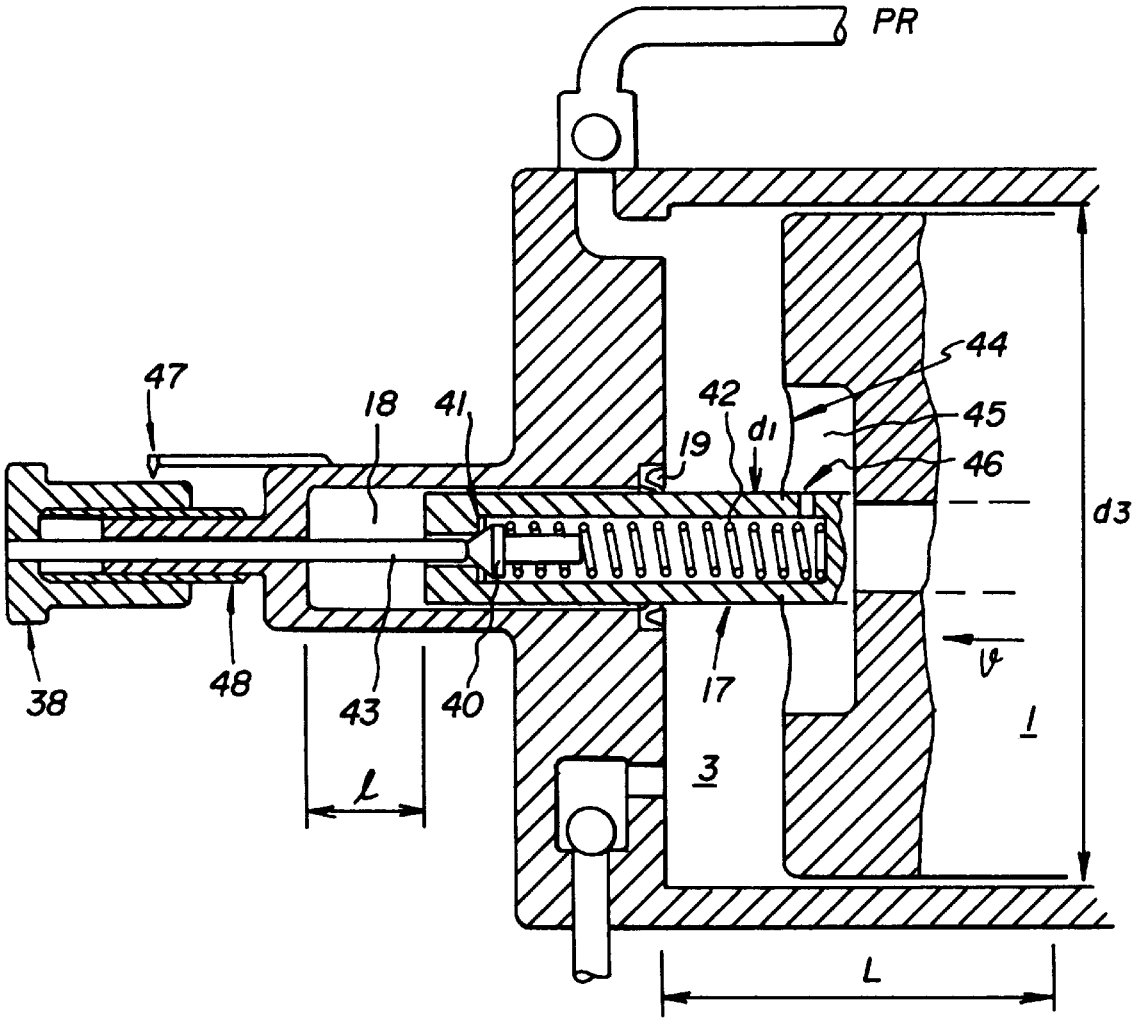

FIG. 20 shows yet another alternative arrangement to adjust the volumetric effect of the piston-cylinder unit 1, 3. In the embodiment shown in FIG. 20, the auxiliary piston-cylinder unit 17, 18 is utilized during part of the movement of the piston 17 to pump liquid from the cylinder 18 to the cylinder 3. The part of the movement, during which liquid is pumped from the cylinder 18 to the cylinder 3, and correspondingly pumped back from the cylinder 3 to the cylinder 18, is adjusted by means of an axially movable valve-actuating rod 43, that during the movement through the desired path of movement 1 keeps a valve member 40 in the open position against the force of a spring 42 urging the member 40 towards the closing position in abutment against a seal 41. During the movement along this path of movement 1, the volumetric effect of the piston 1 in the cylinder 3 is supplemented by the auxiliary piston-cylinder unit 17, 18, the latter pumping liquid both into and out of the cylinder 3 during the movement towards the left and right, respectively, as shown in FIG. 20. Since equal amounts of liquid are being pumped into and out of the cylinder 18, the piston 1 can be provided with a diaphragm 44 ensuring that the liquid being pumped back and forth between the cylinder 18 and the cylinder 3 in the space 45 limited by the diaphragm 44 is always the same liquid, so that it is not contaminated by the liquid being circulated. The axial position of the valve-actuating rod 43 is adjusted by means of an adjusting screw 38 in engagement with a thread 48, and the position of the adjusting screw 38 can possibly be read by means of a scale on the screw co-operating with a pointer 47.

Figure 21:
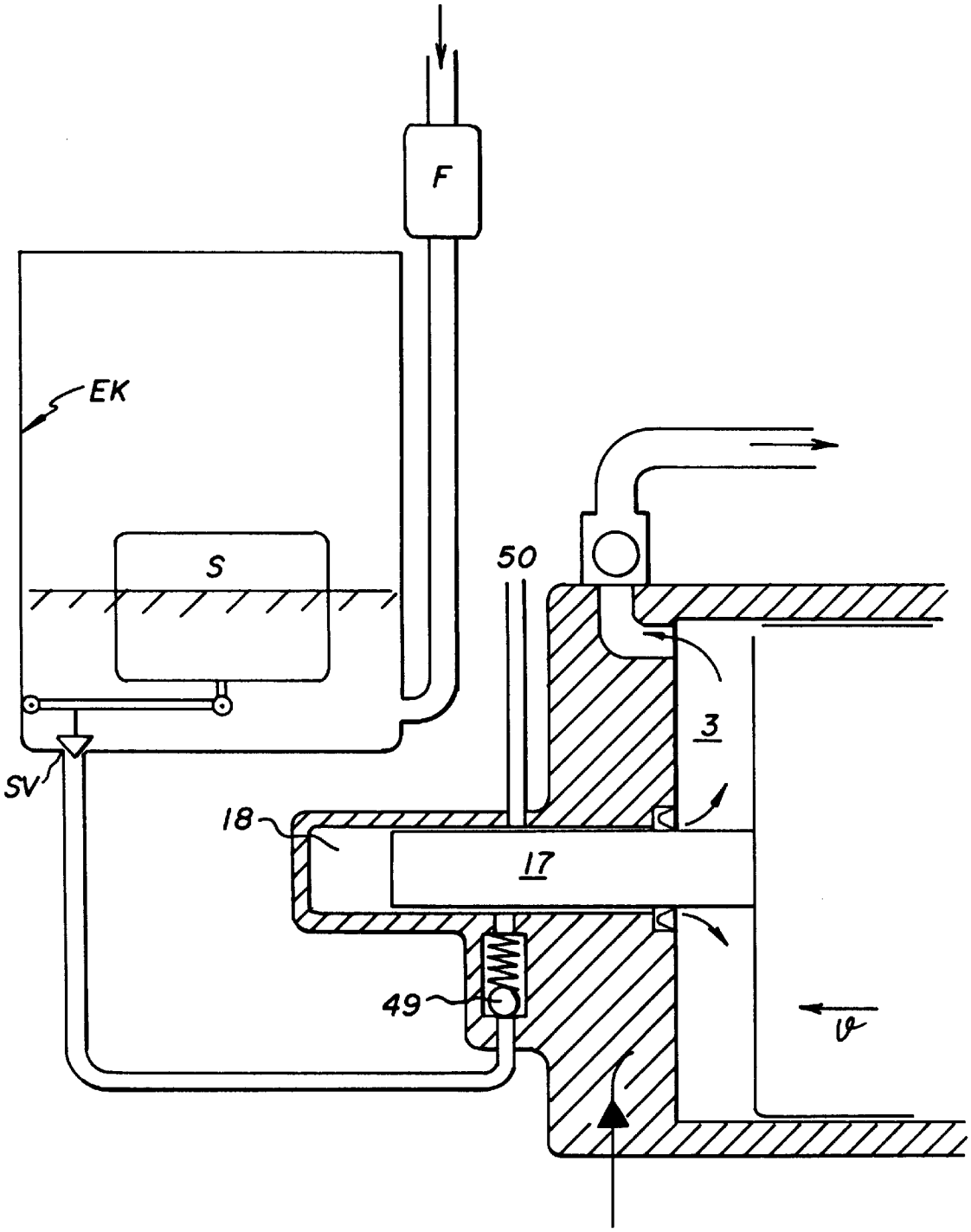
FIG. 21 shows the use of an auxiliary cylinder for pumping surplus liquid back from the secondary circuit to the primary circuit.

In connection with the embodiments, in which more liquid is pumped into the secondary circulatory system than away from it, e.g. a shown in FIGS. 12, 13, 14 and 15, the arrangement shown in FIG. 21 can be used. With this arrangement, the auxiliary piston-cylinder unit 17, 18 is used for pumping surplus liquid back from an expansion tank EK via a float valve SV and a non-return valve 49 conducting the liquid to the cylinder 18 and, via the lip seal 19 and the cylinder 3, to the primary return flow. Surplus liquid dripping from the various overflows shown in the above-mentioned Figures or the like is conducted to the expansion tank EK via a filter F, the latter provided to prevent contamination of the valves SV and 49, and the auxiliary piston-cylinder unit 17, 18 aspirates liquid from the expansion tank EK as long as the float S keeps the valve SV open, and the non-return valve 49 ensures that the higher pressure in the auxiliary piston-cylinder unit 17, 18 forces the liquid past the lip seal 19 into the cylinder 3. The auxiliary piston-cylinder unit 17, 18 could possibly be provided with an automatic escape tube 50, not shown in detail, so that steam and air can escape from the cylinder 18.

Figure 22:
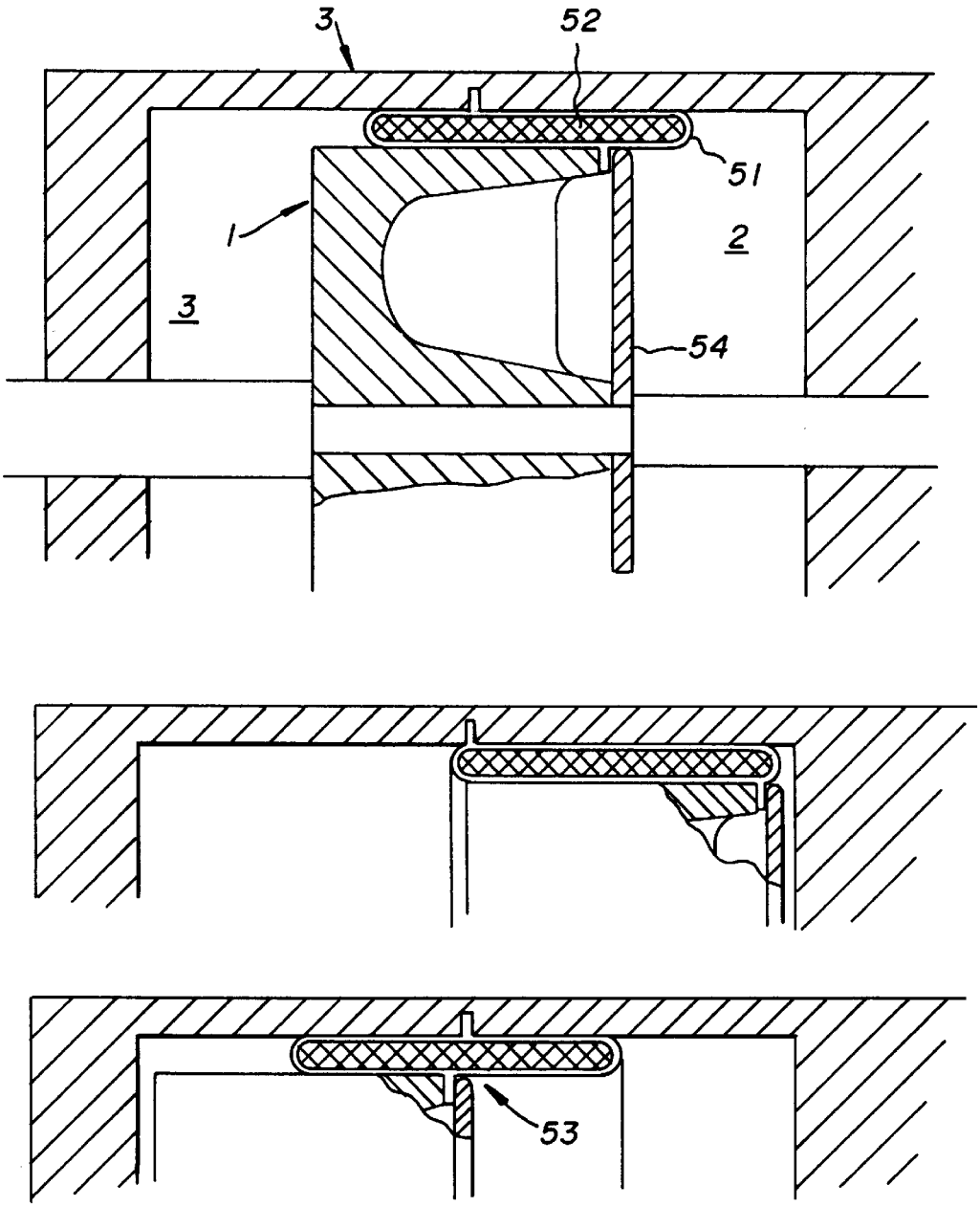
FIGS. 22–24 show a rolling seal for sealing and insulation between piston and cylinder in the apparatus according to the invention.
Figure 24:
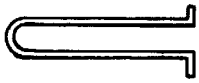
Figure 23:
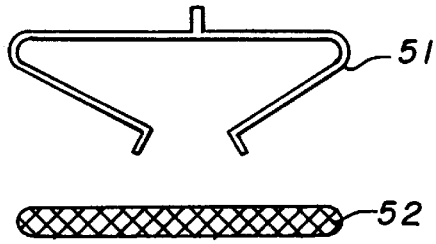

In order to ensure an effective seal between the pistons 1, 1' and the associated cylinders, 2, 3, 2', 3', a rolling seal 51 of a kind known per se can be placed between them, normally having a cross-sectional shape as shown in FIG. 24. The piston-cylinder units according to the present invention are, however, intended to circulate liquid in the separate cylinders 2, 2' and 3, 3', respectively having different temperatures, as no heat exchange between the liquids separated by the pistons 1, 1' is desired. To minimize the heat exchange between the liquids in the chambers separated by the pistons 1, 1', the rolling diaphragm 51 can be in the form of a double rolling diaphragm as shown in FIGS. 22 and 23, respectively. To provide additional protection against heat exchange between the liquids via the piston 1, the rolling diaphragm can have the form shown in FIG. 22, so that its substantially toroid-shaped internal space is filled with an insulating material 52. As shown in FIG. 22, in the extreme position shown in the middle part of FIG. 22, the rolling diaphragm and the insulating material cover completely the side of the piston 1 facing the wall of the cylinder. In the opposite extreme position shown below in FIG. 22, the insulating material 52 in the rolling diaphragm 51 covers half of the side wall of the piston 1 facing the cylinder 3. In this manner it is ensured that this side wall of the piston 1 does not contribute to heat exchange between the liquids in the two chambers separated by the piston 1. In addition to this, a shield 54 may be placed on the side of the piston 1 facing the chamber defined by the piston 1 and the cylinder 2, 3, so that the liquid present in this chamber is also prevented from exchanging heat with the piston 1 on the latter's rear side. In this manner, the piston 1 is thermally insulated from the liquid in the chamber defined by the piston 1 and the cylinder 2. A cavity between the shield 54 and the piston 1 may be filled with air or liquid, and in the latter case, the shield 54 is preferably made of insulating material.

The insulating material 52 can be a liquid material or alternatively, as shown in FIG. 23, consist of a ring of an insulating plastic material embedded in the substantially toroid-shaped rolling diaphragm 51. In order to equalize the pressure in the toroid-shaped rolling diaphragm 51, the latter can be provided with a small opening 53 communicating the inner space of the rolling diaphragm with the chamber defined by the piston 1 and the cylinder 2.

What is claimed is:

1. Apparatus for use in a liquid circulation system, which liquid system comprises a liquid, a primary circulatory circuit provided with a circulation pump for the liquid and having a primary forward flow and a primary return flow, as well as a secondary circulatory circuit provided with a utilization device for the liquid having a secondary forward flow to the utilization device and a secondary return flow from the utilization device, the apparatus comprising:

a primary inlet which receives liquid from the primary forward flow, a primary outlet which delivers liquid to the primary return flow, a secondary inlet which receives liquid from the secondary return flow, a secondary outlet which delivers liquid to the secondary forward flow, two positively interconnected displacement machines (A, B), of which one displacement machine (A) receives the liquid of the primary forward flow (F.F.) from the primary inlet and delivers the liquid of the secondary forward flow (S.F.) to the secondary outlet, and of which the other displacement machine (B) receives the liquid of the secondary return flow (S.R.) from the secondary inlet and delivers the liquid of the primary return flow (P.R.) to the primary outlet, and a flow equalization means whereby the volumetric effects of the displacement machines (A, B) are attuned to each other in a manner to ensure that the volume flows in the primary forward flow, the secondary forward flow, the secondary return flow and the primary return flow are substantially equal.

2. Apparatus according to claim 1, characterized in that the flow equalization means is made by the one of the two displacement machines (A, B) operating as a pump having a basically greater volumetric effect than the one operating as a motor, and that this basically greater volumetric effect is reduced by means of a pressure-controlled bypass (T) from the delivery side of the pump to its inlet side of said bypass being open for return flow when the pressure on the inlet side of the pump falls below a predetermined level or the pressure on the delivery side of the pump rises above a predetermined level.

3. Apparatus according to claim 1, characterized in that said two displacement machines consist of four mechanically interconnected reciprocating piston-cylinder units operating in pairs in counter-phase, of which one pair of piston-cylinder units operating in counter-phase functions as a displacement motor and the other pair functions as a displacement pump, achieved by suitable valve control of the inlet flow and the delivery flow of the liquid to and from said piston-cylinder units.

4. Apparatus according to claim 3, characterized in that the liquid flows to and from the displacement pump are controlled by simple non-return valves.

5. Apparatus according to claim 3, characterized in that the liquid flows to and from the displacement motor are controlled by a set of valves being switched substantially instantaneously in the two extreme positions of the pistons.

6. Apparatus according to claim 3, characterized in that the four piston-cylinder units consist of two cylinders placed in coaxial extension of each other, each cylinder being divided into two parts by a piston, the two pistons being interconnected via a piston rod extending sealingly through a stationary central member sealingly separating the two cylinders.

7. Apparatus according to claim 6, characterized in that the motor is constituted by the piston-cylinder pair situated internally of the pistons and facing said central member, and that the volumetric effect of the motor is reduced to the effective area of the piston as reduced by the area of the piston rod.

8. Apparatus according to claim 6, characterized in that the axial length of the pistons is of the same order of magnitude as the length of their stroke in the cylinders.

9. Apparatus according to claim 6, characterized in that the piston rod is extended (17) through the pistons and at the end wall for the outer cylinders (3, 3') are guided in and co-operate with external auxiliary cylinders (18, 18'), the latter preferably being interconnected via a bore through the piston rod (4, 17, 17'), whereby the volumetric effect of the outer piston-cylinder unit (1, 1', 3, 3') is reduced to the effective area of the piston (1, 1') as reduced by the area of the externally situated piston rod (17, 17').

10. Apparatus according to claim 9, characterized in that the diameter ($d_1$) of the externally situated piston rod (17, 17') is greater than the diameter ($d_2$) of the internally situated piston rod (4), so that the pump and the motor have roughly the same volumetric effect, the difference between said diameters compensating for the change in specific weight caused by a cooling of the liquid in the secondary circulatory system.

11. Apparatus according to claim 9, characterized in that the volumetric effect of the pump is greater than of the motor, and that the excess amount is compensated by means of a pressure-controlled bypass for a return flow.

12. Apparatus according to claim 11, characterized in that the pressure-controlled return flow is provided by means of a float (S) in an expansion tank (EK) in the secondary circulatory circuit, said float allowing liquid to flow back from the primary return flow to the expansion tank (EK).

13. Apparatus according to claim 9, characterized in that the volumetric effect of the pump is less than that of the motor, and that the corresponding surplus of liquid in the secondary circuit is drained by a pressure-controlled overflow (B) or a pressure-controlled valve (A).

14. Apparatus according to claim 13, characterized in that the overflow liquid is pumped to the primary return flow by means of an auxiliary cylinder-piston unit (17, 17', 18, 18').

15. Apparatus according to claim 14, characterized in that the return pumping occurs via a collection tank (EK), from which the liquid is conducted to the auxiliary cylinder (18, 18') via a float-controlled (S) valve (SV) being open when the liquid level in said tank (EK) is high, and a non-return valve (49, 49'), and liquid from the auxiliary cylinder (18, 18') is conducted to the return flow via an additional non-return valve.

16. Apparatus according to claim 9, characterized in that the volumetric effect is adjustable.

17. Apparatus according to claim 16, characterized in that said adjustability is provided by means of a rotatable sleeve (28) on the piston rod (4), said sleeve along an adjustable part of the movement of the piston rod barring or allowing, respectively, liquid flow from the secondary return flow to a pair of bores in the piston rod (4) leading to the auxiliary cylinders (18, 18'), respectively, formed in the end walls, said sleeve being V-shaped, the adjustment being carried out by rotating the sleeve via an adjustment mechanism, and the liquid being pumped from the auxiliary cylinder (18, 18') to the return flow via a non-return valve.

18. Apparatus according to claim 16, characterized in that said adjustability is provided by means of a rotatable sleeve (28) on the piston rod (4), said sleeve along an adjustable part of the movement of the piston rod barring or allowing, respectively, liquid flow from the secondary return flow to a bore in the piston rod leading to the an auxiliary cylinder (18) formed in the end wall via a non-return valve (29), said sleeve being V-shaped and the adjustment being carried out by rotating the sleeve via an adjustment mechanism and the liquid being pumped from the auxiliary cylinder (18) to the return flow via a non-return valve.

19. Apparatus according to claim 16, characterized in that said adjustability is provided by means of an auxiliary piston (30) following the movement of the piston (1) along an adjustable part of said movement, the distance (1), through which the auxiliary piston protrudes inwardly from the end wall, in which it is supported sealingly and movably parallel to the piston (1), being adjustable by an adjustment screw (38) and a locking nut (39), the return movement of the auxiliary piston being provided by a spring (37).

20. Apparatus according to claim 16, characterized in that said adjustability is provided by keeping open a valve (40) along the adjustable portion (1) of the movement of an auxiliary piston (17) in an auxiliary cylinder (18) formed in the end wall of the cylinder-piston unit (1, 3), said valve communicating the auxiliary cylinder (18) and the cylinder (3) via a bore in piston-rod extension or piston (17) and a transverse bore (46), said valve (40), being adapted to close against a seal (41) by a spring (42), being made to open by an axially adjustable valve-actuating rod (43) when the piston (17) moves axially towards the rod (43), the distance, through which the rod (43) protrudes into the cylinder (18), being adjustable by means of an adjustment screw (38) in engagement with a thread (48).

21. Apparatus according to claim 20, characterized in that the outlet from the transverse bore (46) debouches in a chamber (45) being separated from the internal space of the cylinder (3) by an internal diaphragm (44).

22. Apparatus according to claim 6, characterized in that a seal between the pistons (1, 1') and the cylinders (2, 2', 3, 3') is provided in the form of a rolling diaphragm clamped in the wall of the cylinder (2, 2', 3, 3') and in the piston (1, 1'), respectively.

23. Apparatus according to claim 22, characterized in that the rolling diaphragm (51) is substantially toroid-shaped with a cavity, the cavity preferably being filled with an insulating material (52).

24. Apparatus according to claim 23, characterized in that the rolling diaphragm (51) is clamped in such a manner and has such an extent, that in one extreme position of the piston, the rolling diaphragm and the insulating material are situated along the side of the piston (1) facing the cylinder (2, 3) completely covering this side, and that in the other extreme position of the piston, the side of the piston (1) is correspondingly half-covered by the rolling diaphragm (51) and the insulating material (52).

25. Apparatus according to claim 24, characterized in that the piston (1, 1') on the side facing the above-mentioned one extreme position is provided with a shield (54), preferably made of insulating material.

26. Apparatus according to claim 24, characterized in that the rolling diaphragm is provided with a pressure-equalizing opening (53) communicating the cavity with the cylinder on one side of the piston (1, 1').

27. Apparatus according to claim 15, characterized in that the non-return valve is a U-shaped lip seal for the auxiliary cylinder-piston unit (17, 17', 18, 18').

28. Apparatus according to claim 27, characterized in that the non-return valve is also provided with an automatic escape device (50).

29. Apparatus according to claim 17, characterized in that the non-return valve is a U-shaped lip seal for piston (17, 17') in the cylinder (18, 18').

* * * * *